US009347168B2

(12) United States Patent
Kim et al.

(10) Patent No.: US 9,347,168 B2
(45) Date of Patent: May 24, 2016

(54) RECEPTION NODE AND TRANSMISSION NODE USING MUTUAL RESONANCE, POWER AND DATA TRANSCEIVING SYSTEM USING MUTUAL RESONANCE, AND METHOD THEREOF

(71) Applicant: Samsung Electronics Co., Ltd., Suwon-si (KR)

(72) Inventors: Dong Zo Kim, Yongin-si (KR); Sang Wook Kwon, Seongnam-si (KR); Ki Young Kim, Yongin-si (KR); Nam Yun Kim, Seoul (KR); Bong Chul Kim, Seoul (KR); Yun Kwon Park, Dongducheon-si (KR); Jae Hyun Park, Yongin-si (KR); Keum Su Song, Seoul (KR); Chi Hyung Ahn, Suwon-si (KR); Young Ho Ryu, Yongin-si (KR); Chang Wook Yoon, Seoul (KR); Byoung Hee Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 170 days.

(21) Appl. No.: 14/155,850

(22) Filed: Jan. 15, 2014

(65) Prior Publication Data

US 2014/0204860 A1 Jul. 24, 2014

(30) Foreign Application Priority Data

Jan. 22, 2013 (KR) ..... 10-2013-0006816

(51) Int. Cl.

| | |
|---|---|
| ***G08B 23/00*** | (2006.01) |
| ***D06F 39/00*** | (2006.01) |
| ***D06F 33/02*** | (2006.01) |

(52) U.S. Cl.

CPC ..... *D06F 39/005* (2013.01); *D06F 33/02* (2013.01); *D06F 39/003* (2013.01); *D06F 39/004* (2013.01); *D06F 2202/02* (2013.01); *D06F 2202/04* (2013.01); *D06F 2202/10* (2013.01); *D06F 2202/12* (2013.01); *D06F 2204/065* (2013.01); *D06F 2204/086* (2013.01); *D06F 2210/00* (2013.01)

(58) Field of Classification Search

CPC ..... H02J 7/025; H01F 38/00; H04B 5/0037; H04B 5/0075

USPC ..... 340/572.5, 572.1, 505, 539.1, 691.6, 340/10.1, 13.26; 320/108; 370/310

See application file for complete search history.

(56) References Cited

U.S. PATENT DOCUMENTS 5,798,694 A * 8/1998 Reber et al. ..... 340/540
7,680,691 B2 * 3/2010 Kimball et al. ..... 705/22

(Continued)

FOREIGN PATENT DOCUMENTS

JP 2006-214644 A 8/2006
JP 2007-113858 A 5/2007

(Continued)

*Primary Examiner* — Phung Nguyen
(74) *Attorney, Agent, or Firm* — NSIP Law

(57) ABSTRACT

A reception (RX) node using mutual resonance includes a target resonator configured to receive power via mutual resonance with a source resonator; a controller configured to wake up in response to the received power, determine a point in time at which the controller woke up to be a point in time at which synchronization with other RX nodes is performed, and generate a data packet, and a sensor configured to wake up in response to the received power, sense information.

21 Claims, 17 Drawing Sheets

(56) References Cited

U.S. PATENT DOCUMENTS

| | | | | |
|---|---|---|---|---|
| 7,982,601 | B2 * | 7/2011 | Corrado et al. | 340/539.22 |
| 8,242,911 | B2 * | 8/2012 | Moore et al. | 340/572.1 |
| 8,670,710 | B2 * | 3/2014 | Miles | 455/41.1 |
| 2005/0093703 | A1 * | 5/2005 | Twitchell | 340/572.8 |
| 2011/0148650 | A1 | 6/2011 | Jenkins et al. | |
| 2012/0161538 | A1 * | 6/2012 | Kinoshita et al. | 307/104 |

FOREIGN PATENT DOCUMENTS

| | | | |
|---|---|---|---|
| JP | 2009-124895 | A | 6/2009 |
| KR | 10-0535328 | B1 | 12/2005 |
| KR | 10-0755143 | B1 | 9/2007 |
| KR | 10-0788159 | B1 | 12/2007 |
| KR | 10-2008-0076065 | A | 8/2008 |
| KR | 10-0878822 | B1 | 1/2009 |

* cited by examiner

RECEPTION NODE AND TRANSMISSION NODE USING MUTUAL RESONANCE, POWER AND DATA TRANSCEIVING SYSTEM USING MUTUAL RESONANCE, AND METHOD THEREOF

CROSS-REFERENCE TO RELATED APPLICATIONS

This application claims the benefit under 35 USC 119(a) of Korean Patent Application No. 10-2013-0006816 filed on Jan. 22, 2013, in the Korean Intellectual Property Office, the entire disclosure of which is incorporated herein by reference for all purposes.

BACKGROUND

1. Field

The following description relates to an apparatus and a method for wirelessly transceiving both power and data using mutual resonance.

2. Description of Related Art

Research on wireless power transmission has been conducted to overcome an increase in the inconvenience of wired power supplies or the limited capacity of conventional batteries due to an explosive increase in various electronic devices including electric vehicles, mobile devices, and other portable devices. One type of wireless power transmission technology uses resonance characteristics of radio frequency (RF) devices. For example, a wireless power transmission system using resonance characteristics may include a source configured to supply power, and a target configured to receive the supplied power.

SUMMARY

In one general aspect, a reception (RX) node using mutual resonance comprises a target resonator configured to receive power via mutual resonance with a source resonator; a sensor configured to sense information in response to the received power; a controller configured to, in response to the received power: generate a data packet comprising the sensed information; and transmit the data packet to the source resonator via the target resonator at a timing selected to prevent the RX node from colliding with any other RX node.

The controller may be further configured to generate the data packet so that the data packet includes identification information of the RX node; sensing information sensed by the sensor; a time required to transmit the data packet, and a data transmission waiting time set for the RX node to prevent the RX node from colliding with the other RX nodes during data transmission.

The RX node may further include a modulator configured to modulate the data packet using a load modulation scheme; and the target resonator may be further configured to transmit the modulated data packet to the source resonator via the mutual resonance.

The power received by the target resonator may be alternating current (AC) power; and the RX node may further include a rectifier configured to receive the AC power from the target resonator, and rectify the AC power to direct current (DC) power; and a DC-to-DC (DC/DC) converter configured to convert a voltage level of the DC power to a rated voltage level of the controller, and convert the voltage level of the DC power to a rated voltage level of the sensor.

The controller may be further configured to output a sensing request; the sensor may include a battery configured to be charged by the received power; and the sensor may be further configured to receive the sensing request from the controller, determine whether an amount of power stored in the battery is equal to or greater than a minimum amount of power the sensor needs to sense the information, and sense the information in response to the sensing request and a result of the determining being that the amount of power stored in the battery is equal to or greater than the minimum amount of power the sensor needs to sense the information.

The source resonator may be mounted in a door of a kimchi refrigerator; the target resonator, the controller, and the sensor may be mounted in a kimchi container of the kimchi refrigerator; the sensor may be further configured to sense an acidity of kimchi in the kimchi container, and an internal temperature of the kimchi container; and the controller may be further configured to determine an aging state of the kimchi based on the acidity.

The source resonator may be mounted in a door of a washing machine; the target resonator, the controller, and the sensor may be mounted in a washing container of the washing machine; the sensor may be further configured to sense any one or any combination of a weight of laundry in the washing container, a pressure of water flowing into the washing container, an internal temperature of the washing container, and an internal humidity of the washing container; and the controller may be further configured to determine a washing state of the laundry.

In another general aspect, a transmission (TX) node using mutual resonance includes a source resonator configured to transmit power via mutual resonance with a target resonator of an RX node, and receive a signal from the target resonator, the signal having been generated by the RX node load-modulating a data packet; a demodulator configured to demodulate the data packet based on a change in a waveform of the signal received by the source resonator; and a controller configured to display information in the demodulated data packet on a display window.

The controller may be further configured to determine an amount of power to be transmitted by the source resonator based on a power level needed to wake up a controller and a sensor of the RX node.

The controller may be further configured to interrupt transmission of the power from the source resonator in response to completion of receiving of the data packet from the RX node; and restart transmission of the power from the source resonator in response to a predetermined delay period elapsing after the interruption of the transmission of the power.

The TX node may further include a frequency generator configured to generate a signal having a resonant frequency enabling the source resonator and the target resonator to mutually resonate; and an amplifier configured to amplify the signal having the resonant frequency to a controllable power level; and the controller may be further configured to control the amplifier to control the power level of the amplified signal.

The source resonator, the demodulator, and the controller may be mounted in a door of a kimchi refrigerator; the RX node may be mounted in a kimchi container of the kimchi refrigerator; and the controller may be further configured to acquire an aging state of kimchi in the kimchi container from the demodulated data packet, and display the acquired aging state on the display window.

The source resonator, the demodulator, and the controller may be mounted in a door of a washing machine; the RX node may be mounted in a washing container of the washing machine; and the controller may be further configured to acquire washing information of laundry in the washing container from the demodulated data packet, and display the acquired washing information on the display window.

In another general aspect, a system for transceiving power and data using mutual resonance includes a transmission (TX) node including a source resonator configured to transmit power; and a plurality of reception (RX) nodes each including a target configured to receive power from the source resonator via mutual resonance with the source resonator; a controller configured to wake up in response to the received power, determine a point in time at which the controller wakes up to be a point in time at which synchronization with other RX nodes of the plurality of RX nodes is performed, and generate a data packet; and a sensor configured to wake up in response to the received power, and sense information; the source resonator and the target resonator of each of the plurality of RX nodes may be further configured so that the source resonator mutually resonates with the target resonator of each of the plurality of RX nodes at a same resonant frequency.

The TX node may be mounted in a door of a kimchi refrigerator; the plurality of RX nodes are respectively mounted in a plurality of kimchi containers of the kimchi refrigerator; the sensor of each of the plurality of RX nodes may be further configured to sense an acidity of kimchi in a respective one of the plurality of kimchi containers, and an internal temperature of the respective one of the plurality of kimchi containers; the controller of each of the plurality of RX nodes may be further configured to determine an aging state of the kimchi in the respective one of the kimchi containers based on the acidity, and generate the data packet so that the data packet includes identification information of a respective one of the plurality of RX nodes, the acidity, the internal temperature, the aging state, a time required to transmit the data packet, and a data packet transmission waiting time set for the respective one of the plurality of RX nodes to prevent the respective one of the plurality of RX nodes from colliding with the other RX node of the plurality of RX nodes; the target resonator of each of the plurality of RX nodes may be further configured to transmit the data packet of the respective one of the plurality of RX nodes to the source resonator of the TX node via the mutual resonance; the source resonator of the TX node may be further configured to receive the data packet from the target resonator of each of the plurality of RX nodes via the mutual resonance; the TX node may be further configured to acquire the aging state of the kimchi in each of the plurality of kimchi containers and the internal temperature of each of the plurality of kimchi containers from the data packet of each of the plurality of RX nodes received by the source resonator, and display on a display window of the kimchi refrigerator the acquired aging state of the kimchi in each of the plurality of kimchi containers and the acquired internal temperature of each of the plurality of kimchi containers.

Each of the plurality of RX nodes may be further configured to generate a signal by load-modulating the data packet; the target resonator of each of the plurality of RX nodes may be further configured to transmit the signal to the source resonator of the TX node via the mutual resonance; the source resonator of the TX node may be further configured to receive the signal from the target resonator of each of the plurality of RX nodes via the mutual resonance; and the TX node may further include a demodulator configured to demodulate the data packet of each of the plurality of RX nodes based on a change in a waveform of the signal received by the source resonator from the target resonator of each of the plurality of RX nodes, and a controller configured to acquire information from the demodulated data packet of each of the plurality of RX nodes, and display the acquired information on a display window.

In another general aspect, a method of transceiving power and data using mutual resonance includes transmitting, by a source resonator of a transmission (TX) node, power to a target resonator of each of a plurality of reception (RX) nodes via mutual resonance between the source resonator and the target resonator of each of the plurality of RX nodes; in each of the plurality of RX nodes, receiving, by the target resonator, power from the source resonator, and rectifying the received power; in each of the plurality of RX nodes, waking up a controller and a sensor of the RX node in response to the received power; in each of the plurality of RX nodes, sensing, by the sensor, information; in each of the plurality of RX nodes, generating, by the controller of the RX node, a data packet; in each of the plurality of RX nodes, modulating, by a modulator of the RX node, the data packet using a load modulation scheme in response to elapsing of a respective data transmission waiting time set for the RX node to prevent the RX node from colliding with other RX nodes of the plurality of RX nodes; receiving, by the source resonator, the signal from each of the plurality of RX nodes; demodulating, by a demodulator of the TX node, the modulated data packet of each of the plurality of RX nodes based on a change in a waveform of the signal received by the source resonator from each of the plurality of RX nodes; displaying, by the controller of the TX node, information in the demodulated data packet of each of the plurality of RX nodes on a display window; and interrupting, by the controller of the TX node, transmission of the power.

The TX node may be mounted in a door of a kimchi refrigerator; the plurality of RX nodes are respectively mounted in a plurality of kimchi containers of the kimchi refrigerator; and the method may further include in each of the plurality of RX nodes, sensing, by the sensor, an acidity of kimchi in a respective kimchi container of the plurality of kimchi containers, and an internal temperature of the respective kimchi container; and in each of the plurality of RX nodes, determining, by the controller of the RX node, an aging state of the kimchi based on the acidity.

The method may further include generating, by the controller of each of the plurality of data packets, the data packet so that the data packet includes identification information of a respective one of the plurality of RX nodes, the acidity, the internal temperature, the aging state, a time required to transmit the data packet, and a data packet transmission waiting time set for the RX node to prevent the RX node from colliding with other RX nodes of the plurality of RX nodes.

The display window may be a display window of the kimchi refrigerator; and the displaying may include acquiring, by the controller of the TX node, the aging state of the kimchi in each of the plurality of kimchi containers and the internal temperature of each of the plurality of kimchi containers from the demodulated data packet of each of the plurality of RX nodes; and displaying, by the controller of the TX node, on the display window of the kimchi refrigerator the acquired aging state of the kimchi in each of the plurality of kimchi containers and the acquired internal temperature of each of the plurality of kimchi containers.

In another general aspect, a reception (RX) node using mutual resonance includes a target resonator configured to receive power via mutual resonance with a source resonator; a sensor configured to sense information in response to the received power; a controller configured to, in response to the received power, generate a data packet including the sensed information, and transmit the data packet to the source resonator via the target resonator at a timing selected to prevent the RX node from colliding with any other RX node.

The target resonator may be further configured to mutually resonate with the source resonator at a same resonant frequency at which a target resonator of each RX node of the any other RX node is configured to mutually resonate with the source resonator.

The controller may be further configured to transmit the data packet to the source resonator via the target resonator after a data transmission waiting time elapses from a time the power is received by the target resonator; and the data transmission waiting time may be set for the RX node to prevent the RX node from colliding with the any other RX node.

Other features and aspects will be apparent from the following detailed description, the drawings, and the claims.

BRIEF DESCRIPTION OF THE DRAWINGS

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

Figure 1:
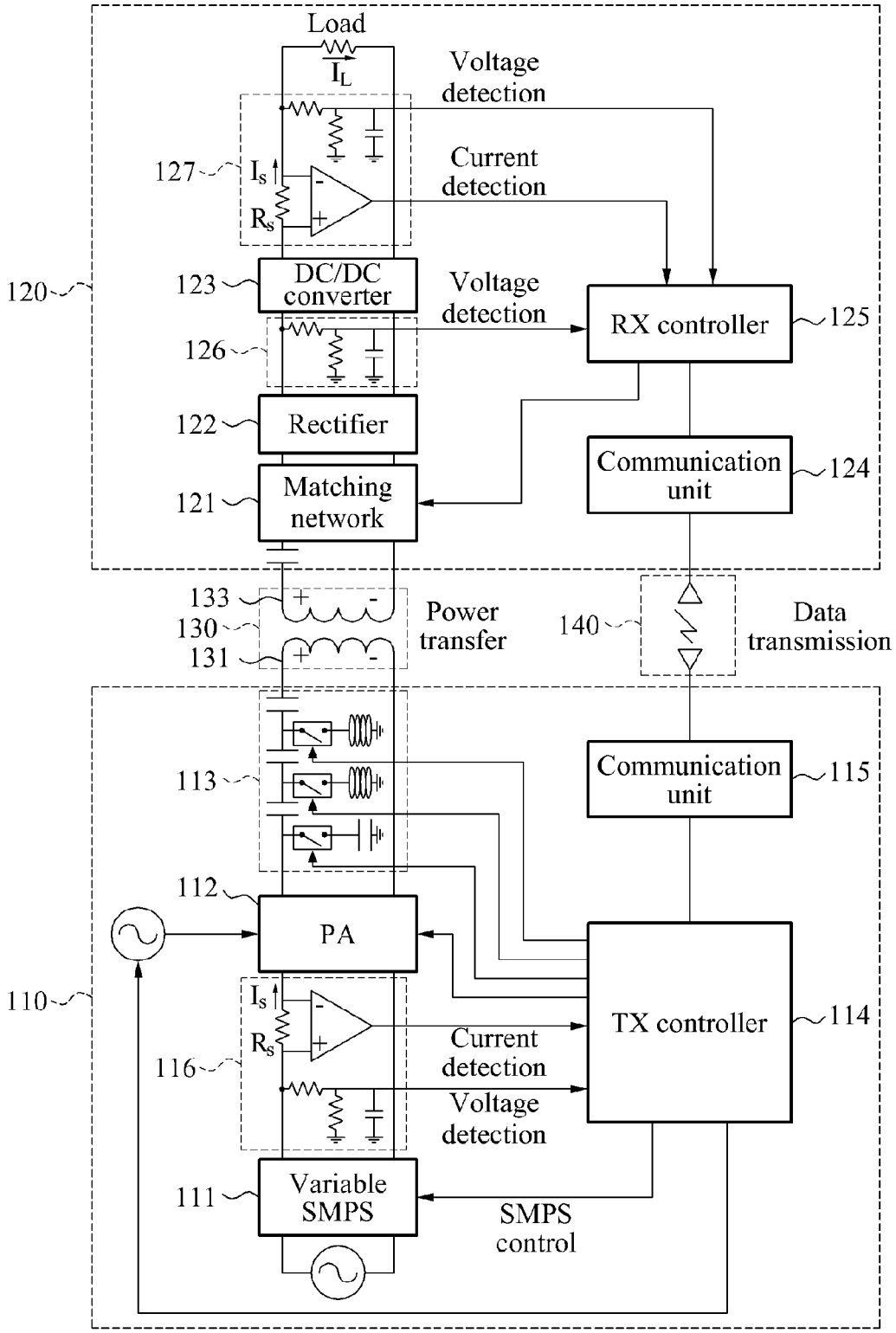
FIG. 1 illustrates an example of a system for transceiving power and data using mutual resonance.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, description of functions and constructions that are well known to one of ordinary skill in the art may be omitted for increased clarity and conciseness.

Throughout the drawings and the detailed description, the same reference numerals refer to the same elements. The drawings may not be to scale, and the relative size, proportions, and depiction of elements in the drawings may be exaggerated for clarity, illustration, and convenience.

In a system configured to transceive power using a wireless resonance scheme, an apparatus configured to provide power may be defined to be a source, and an apparatus configured to receive the provided power may be defined to be a target. Depending on the situation, an apparatus operated as a source may be operated as a target, and an apparatus operated as a target may be operated as a source.

FIG. 1 illustrates an example of a system for transceiving power and data using mutual resonance. Referring to FIG. 1, the system includes a source 110 and a target 120. The source 110 is a device configured to supply wireless power, and may be any electronic device capable of supplying power, for example, a pad, a terminal, a tablet personal computer (PC), a television (TV), a medical device, or an electric vehicle. The target 120 is a device configured to receive wireless power, and may be any electronic device requiring power to operate, for example, a pad, a terminal, a tablet PC, a medical device, an electric vehicle, a washing machine, a radio, or a lighting system.

The source 110 includes a variable switching mode power supply (SMPS) 111, a power amplifier (PA) 112, a matching network 113, a transmission (TX) controller 114 (for example, TX control logic), a communication unit 115, and a power detector 116.

The variable SMPS 111 generates a direct current (DC) voltage by switching an alternating current (AC) voltage having a frequency in a band of tens of hertz (Hz) output from a power supply. The variable SMPS 111 may output a DC voltage having a predetermined level, or may output a DC voltage having a voltage that may be adjusted under control of the TX controller 114.

The variable SMPS 111 may control its output voltage based on a level of power output from the PA 112 so that the PA 112 may operate in a saturation region with high efficiency at all times, and may enable a maximum efficiency to be maintained at all levels of the output power of the PA 112. The PA 112 may have, for example, class-E features.

For example, if a fixed SMPS is used instead of the variable SMPS 111, a variable DC-to-DC (DC/DC) converter needs to be provided. In this example, the fixed SMPS outputs a fixed voltage to the variable DC/DC converter, and the variable DC/DC converter controls its output voltage based on the level of the power output from the PA 112 so that the PA 112 may be operate in the saturation region with high efficiency at all times, and may enable the maximum efficiency to be maintained at all levels of the output power of the PA 112.

The power detector 116 detects an output current and an output voltage of the variable SMPS 111, and provides information on the detected current and the detected voltage to the TX controller 114. Additionally, the power detector 116 may detect an input current and an input voltage of the PA 112.

The PA 112 generates power by converting a DC voltage having a predetermined level supplied to the PA 112 by the variable SMPS 111 to an AC voltage using a switching pulse signal having a frequency in a band of a few megahertz (MHz)

to tens of MHz. For example, the PA 112 may convert the DC voltage supplied to the PA 112 to an AC voltage having a reference resonant frequency $F_{Ref}$, and may generate a communication power used for communication, or a charging power used for charging. The communication power and the charging power may be used in a plurality of targets.

The communication power may be low power of 0.1 milliwatt (mW) to 1 mW. The charging power may be a high power of 1 mW to 200 W that is consumed by a device load of a target. As used herein, the term "charging" may refer to supplying power to a unit or an element that is configured to charge a battery or other rechargeable device. Also, the term "charging" may refer to supplying power to a unit or an element that is configured to consume power. For example, the term "charging power" may refer to power consumed by a target while operating, or power used to charge a battery of the target. The units or elements may be, for example, batteries, displays, sound output circuits, main processors, and various sensors.

As used herein, the term "reference resonant frequency" refers to a resonant frequency that is nominally used by the source 110, and the term "tracking frequency" refers to a resonant frequency used by the source 110 that has been adjusted based on a preset scheme.

The TX controller 114 may detect a reflected wave of the communication power or the charging power, and may detect mismatching that may occur between a target resonator 133 and a source resonator 131 based on the detected reflected wave. The TX controller 114 may detect the mismatching by detecting an envelope of the reflected wave, a power amount of the reflected wave, or any other characteristic of the reflected wave that is affected by mismatching.

The matching network 113 compensates for impedance mismatching between the source resonator 131 and the target resonator 133 to achieve optimal matching under the control of the TX controller 114. The matching network 113 includes at least one inductor and at least one capacitor each connected to a respective switch controlled by the TX controller 114.

The TX controller 114 may calculate a voltage standing wave ratio (VSWR) based on a voltage level of the reflected wave and a level of an output voltage of the source resonator 131 or the PA 112. In one example, if the VSWR is greater than a predetermined value, the TX controller 114 may determine that mismatching is detected.

In another example, if the VSWR is greater than the predetermined value, the TX controller 114 may calculate a wireless power transmission efficiency for each of N tracking frequencies, determine a tracking frequency $F_{Best}$ having the best wireless power transmission efficiency among the N tracking frequencies, and adjust the reference resonant frequency $F_{Ref}$ to the tracking frequency $F_{Best}$. The N tracking frequencies may be set in advance.

The TX controller 114 may adjust a frequency of a switching pulse signal used by the PA 112. The frequency of the switching pulse signal may be determined under the control of the TX controller 114. For example, by controlling the PA 112, the TX controller 114 may generate a modulated signal to be transmitted to the target 120. That is, the TX controller 114 may transmit a variety of data to the target 120 using in-band communication. Additionally, the TX controller 114 may detect a reflected wave, and may demodulate a signal received from the target 120 from an envelope of the detected reflected wave.

The TX controller 114 may generate the modulated signal for the in-band communication using various methods. For example, the TX controller 114 may generate the modulated signal by turning the switching pulse signal used by the PA 112 ON and OFF, by performing delta-sigma modulation, or by any other modulation method known to one of ordinary skill in the art. Additionally, the TX controller 114 may generate a pulse-width modulated (PWM) signal having a predetermined envelope.

The TX controller 114 may determine an initial wireless power that is to be transmitted to the target 120 based on a change in a temperature of the source 110, a battery state of the target 120, a change in an amount of power received at the target 120, and/or a change in a temperature of the target 120.

The source 110 may further include a temperature measurement sensor (not illustrated) configured to detect a change in temperature of the source 110. The source 110 may receive from the target 120 information regarding the battery state of the target 120, the change in the amount of power received at the target 120, and/or the change in the temperature of the target 120 via communication with the target 120. The source 110 may detect the change in the temperature of the target 120 based on the information received from the target 120.

The TX controller 114 may adjust a voltage supplied to the PA 112 using a lookup table. The lookup table may be used to store a level of the voltage to be supplied to the PA 112 based on the change in the temperature of the source 110. For example, when the temperature of the source 110 rises, the TX controller 114 may lower the level of the voltage to be supplied to the PA 112 by controlling the variable SMPS 111.

The communication unit 115 performs out-of-band communication using a separate communication channel. The communication unit 115 may include a communication module, such as a ZigBee module, a Bluetooth module, or any other communication module known to one of ordinary skill in the art, that the communication unit 115 may use to perform the out-of-band communication. The communication unit 115 may transmit or receive data 140 to or from the target 120 via the out-of-band communication.

The source resonator 131 transmits electromagnetic energy 130 to the target resonator 133. For example, the source resonator 131 may transmit the communication power and/or the charging power to the target 120 via a magnetic coupling with the target resonator 133.

The target 120 includes a matching network 121, a rectifier 122, a DC/DC converter 123, a communication unit 124, a reception (RX) controller 125 (for example, RX control logic), a voltage detector 126, and a power detector 127.

The target resonator 133 receives the electromagnetic energy 130 from the source resonator 131. For example, the target resonator 133 may receive the communication power and/or the charging power from the source 110 via a magnetic coupling with the source resonator 131. Additionally, the target resonator 133 may receive data from the source 110 via the in-band communication.

The target resonator 133 may receive the initial wireless power that is determined by the TX controller 114 based on the change in the temperature of the source 110, the battery state of the target 120, the change in the amount of power received at the target 120, and/or the change in the temperature of the target 120.

The matching network 121 matches an input impedance viewed from the source 110 to an output impedance viewed from a load of the target 120. The matching network 121 may be configured to have at least one capacitor and at least one inductor.

The rectifier 122 generates a DC voltage by rectifying AC voltage received from the target resonator 133.

The DC/DC converter 123 may adjust a level of the DC voltage output from the rectifier 122 based on a capacity required by the load. For example, the DC/DC converter 123 may adjust the level of the DC voltage output from the rectifier 122 to a level in a range from 3 volts (V) to 10 V.

The voltage detector 126 detects a voltage of an input terminal of the DC/DC converter 123, and the power detector 127 detects a current and a voltage of an output terminal of the DC/DC converter 123. The detected voltage of the input terminal may be used to calculate a wireless power transmission efficiency of the power received from the source 110. The detected current and the detected voltage of the output terminal may be used by the RX controller 125 to calculate an amount of a power actually transferred to the load. The TX controller 114 of the source 110 may calculate an amount of power that needs to be transmitted by the source 110 to the target 120 based on an amount of power required by the load and the amount of power actually transferred to the load.

If the amount of the power actually transferred to the load calculated by the RX controller 125 is transmitted to the source 110 by the communication unit 124, the source 110 may calculate the amount of power that needs to be transmitted to the target 120.

The RX controller 125 may perform in-band communication to transmit and receive data using a resonant frequency. During the in-band communication, the RX controller 125 may demodulate a received signal by detecting a signal between the target resonator 133 and the rectifier 122, or detecting an output signal of the rectifier 122, and demodulating the detected signal. In other words, the RX controller 125 may demodulate a message received via the in-band communication.

Additionally, the RX controller 125 may adjust an impedance of the target resonator 133 using the matching network 121 to modulate a signal to be transmitted to the source 110. For example, the RX controller 125 may adjust the matching network 121 to increase the input impedance of the target resonator 133 so that a reflected wave will be detected by the TX controller 114 of the source 110. Depending on whether the reflected wave is detected, the TX controller 114 may detect a first value, for example a binary number "0," or a second value, for example a binary number "1." For example, when the reflected wave is detected, the TX controller 114 may detect "0", and when the reflected wave is not detected, the TX controller 114 may detect "1". Alternatively, when the reflected wave is detected, the TX controller 114 may detect "1", and when the reflected wave is not detected, the TX controller 114 may detect "0".

The communication unit 124 of the target 120 may transmit a response message to the communication unit 115 of the source 110. For example, the response message may include any one or any combination of a type of the target 120, information on a manufacturer of the target 120, a model name of the target 120, a battery type of the target 120, a charging scheme of the target 120, an impedance value of a load of the target 120, information on characteristics of the target resonator 133 of the target 120, information on a frequency band used by the target 120, an amount of power consumed by the target 120, an identifier (ID) of the target 120, information on a version or a standard of the target 120, and any other information on the target 120.

The communication unit 124 performs out-of-band communication using a separate communication channel. For example, the communication unit 124 may include a communication module, such as a ZigBee module, a Bluetooth module, or any other communication module known to one of ordinary skill in the art, that the communication unit 115 may use to perform the out-of-band communication. The communication unit 124 may transmit and receive the data 140 to or from the source 110 via the out-of-band communication.

The communication unit 124 may receive a wake-up request message from the source 110, and the power detector 127 may detect an amount of power received by the target resonator 133. The communication unit 124 may transmit to the source 110 information on the detected amount of the power received by the target resonator 133. The information on the detected amount of the power received by the target resonator 133 may include, for example, an input voltage value and an input current value of the rectifier 122, an output voltage value and an output current value of the rectifier 122, an output voltage value and an output current value of the DC/DC converter 123, and any other information on the detected amount of the power received by the target resonator 133.

Figure 2:
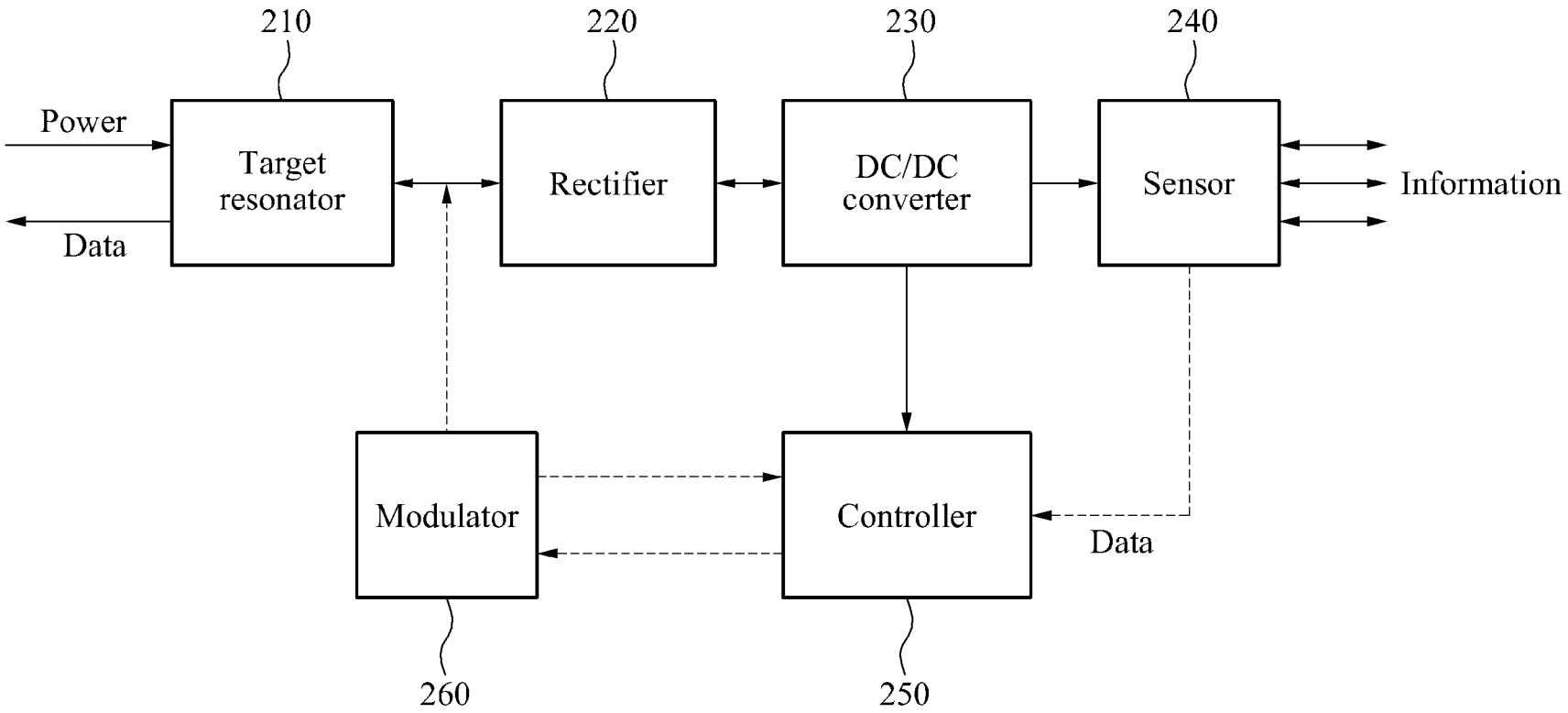
FIG. 2 illustrates an example of a reception (RX) node using mutual resonance.

FIG. 2 illustrates an example of an RX node using mutual resonance. Referring to FIG. 2, the RX node includes a target resonator 210, a rectifier 220, a DC/DC converter 230, a sensor 240, a controller 250, and a modulator 260.

The target resonator 210 receives power via mutual resonance with a source resonator. For example, when a resonant frequency of the target resonator 210 is matched to a resonant frequency of the source resonator, and when the target resonator 210 is located within a predetermined distance from the source resonator, mutual resonance will occur between the target resonator 210 and the source resonator. Power supplied to the source resonator is transmitted to the target resonator 210 via the mutual resonance.

The rectifier 220 rectifies AC power to DC power. The AC power is received from the target resonator 210. The rectifier 220 may function as an AC-to-DC (AC/DC) converter to rectify AC power to DC power. For example, the rectifier 220 may include a full-bridge diode rectifier, a half-bridge diode rectifier, or any other device capable of rectifying AC power to DC power.

The DC/DC converter 230 converts a voltage level of the DC power rectified by the rectifier 220 to a rated voltage level of the controller 250 if necessary. Additionally, the DC/DC converter 230 converts the voltage level of the DC power rectified by the rectifier 220 to a rated voltage level of the sensor 240 if necessary. Power received through the target resonator 210 is supplied to the controller 250 and the sensor 240. For example, the rated voltage level of the sensor 240 and the rated voltage level of the controller 250 may be set based on types of the sensor 240 and the controller 250 in the design of the controller 250 and the sensor 240. In this example, the DC/DC converter 230 may step down the voltage level of the DC power rectified by the rectifier 220 to a set rated voltage level of the controller 250. Additionally, the DC/DC converter 230 may step down the voltage level of the DC power rectified by the rectifier 220 to a set rated voltage level of the sensor 240.

The sensor 240 senses information corresponding to a function of the sensor 240 when the sensor 240 is woken up by received power. In an example in which the sensor 240 does not include a battery, and power for operating the sensor 240 is obtained from power received from the DC/DC converter 230, the sensor 240 may perform a sensing operation when a minimum amount of operating power need to operate the sensor 240 is received. The sensor 240 may perform the sensing operation in real time based on the received power. When power is not received, the sensing operation may be terminated. The sensor 240 may measure a temperature, an acidity (pH), a humidity, a pressure, an acceleration, a weight, or any other measurable quantity depending on a type of the sensor 240.

In another example, the sensor 240 may include a battery. The battery may be charged by power received from the DC/DC converter 230. When an amount of power stored in the battery is equal to or greater than a minimum amount of power needed to perform the sensing operation, the sensor 240 may sense information when a sensing request is received from the controller 250.

The controller 250 may be woken up by the received power, and may determine a point in time at which the controller 250 is woken up to be a point in time at which synchronization with other RX nodes is performed. In an example, the controller 250 may be mounted in each of a plurality of RX nodes, and the controller 250 of each of the RX nodes may be woken up at substantially the same point in time. The controller 250 of each of the RX nodes may determine a point in time at which the controller 250 is woken up to be a synchronization point in time. When a set data transmission waiting time elapses, the controller 250 of each of the RX nodes may transmit a data packet.

The controller 250 may generate a data packet, and may supply the generated data packet to the modulator 260.

The data packet may include, for example, identification information of an RX node, sensing information sensed by an RX node, information on a time required to transmit the data packet for each RX node, and data transmission waiting time information that is set to prevent RX nodes from colliding with each other during transmission of data packets.

The identification information may include, for example, an ID of an RX node. In an example, RX nodes may be distinguished as a first RX node, a second RX node, a third RX node, etc. In another example, RX nodes may be distinguished by separate unique numbers.

The sensing information may vary depending on a type and a function of a sensor.

The data transmission waiting time information may be set in advance for each RX node. When a plurality of RX nodes simultaneously transmit data to a single TX node, data collision may occur if an in-band communication scheme is used. The in-band communication scheme is a communication scheme of transceiving data together with power using a resonant frequency used to transmit power. In other words, times to transmit data may be required to be distinguished for each RX node, and a point in time may be required to be determined as a criterion to distinguish the times.

The controller 250 may determine the point in time at which the controller 250 is woken up to be a criterion. When a data transmission waiting time set for each RX node elapses, each RX node may transmit a data packet.

In an example, a plurality of RX nodes, for example a first RX node, a second RX node, and a third RX node, may be woken up substantially simultaneously by receiving power from a single TX node. In this example, the plurality of RX nodes may wait to transmit data packets until data transmission waiting times set for each of the plurality of RX nodes from a point in time at which each of the plurality of RX nodes is woken up have elapsed. Additionally, a time required to transmit a data packet in each of the plurality of RX nodes may be used.

In an example, data packets may be set to be transmitted in an order of a first RX node, a second RX node, and a third RX node, and a time required to transmit each of the data packets may be set to 0.01 second (s). Additionally, a data transmission waiting time of the first RX node, a data transmission waiting time of the second RX node, and a data transmission waiting time of the third RX node may be set to 0.1 s, 0.2 s, and 0.3 s, respectively. The data transmission waiting times may be set based on the time required to transmit the data packets. For example, a data transmission waiting time may be set to be longer than at least twice a time required to transmit a data packet.

In an example in which 0.1 s elapses from a point in time at which all of the plurality of RX nodes are woken up, the first RX node may transmit a data packet. In another example in which 0.2 s elapses from the point in time at which all of the plurality of RX nodes are woken up, the second RX node may transmit a data packet. In still another example in which 0.3 s elapses from the point in time at which all of the plurality of RX nodes are woken up, the third RX node may transmit a data packet.

The modulator 260 may modulate the data packet generated by the controller 250 using a load modulation scheme. The load modulation scheme may enable information to be modulated by changing an impedance of an RX node by a set value. For example, when a data packet is represented by "101100," the impedance may be increased by the set value at a portion of the data packet corresponding to "1," and the impedance may be reduced by the set value at a portion of the data packet corresponding to "0."

A TX node may acquire information of the impedance changed by the RX node by analyzing a change in a waveform received by a source resonator, and may demodulate information matched to the changed impedance.

The target resonator 210 transmits the data packet modulated by the modulator 260 to a source resonator via the mutual resonance between the target resonator 210 and the source resonator.

An RX node and TX node using mutual resonance may be used in various applications.

In an example, the RX node and the TX node may be mounted in a kimchi refrigerator. In this example, the TX node and the RX node may be mounted in a door and a kimchi container of the kimchi refrigerator, respectively. The kimchi refrigerator may include a plurality of kimchi containers, and an RX node may be mounted in each of the plurality of kimchi containers.

The TX node mounted in the door of the kimchi refrigerator may transmit power via mutual resonance from a source resonator of the TX node to a target resonator of an RX node mounted in each of the plurality of kimchi containers.

The RX node mounted in each of the kimchi containers may be woken up by received power, and may sense an acidity of kimchi in the kimchi containers using a sensor. The sensor may measure an acidity of gas given off by the kimchi, and may sense the acidity of the kimchi. Additionally, the sensor may sense internal temperatures of the kimchi containers. The RX node may determine, using a controller, an aging state of the kimchi based on the acidity of the kimchi sensed by the sensor. As kimchi is fermented, the kimchi becomes more acidic, and accordingly the aging state of the kimchi may be classified based on the acidity of the kimchi. The RX node may transmit information on the aging state of the kimchi to the TX node. The TX node may display, on a display window of the kimchi refrigerator, the information on the aging state, and temperatures of the kimchi containers. A user may maintain a current aging state of the kimchi, or control the kimchi to be more quickly fermented, by checking the aging state of the kimchi displayed on the display window, and by adjusting the temperatures of the kimchi containers.

In another example, the RX node and the TX node may be mounted in a washing machine. In this example, the TX node and the RX node may be mounted in a door and a washing container of the washing machine, respectively. The washing machine may include a plurality of washing containers, and an RX node may be mounted in each of the plurality of washing containers.

The TX node mounted in the door of the washing machine may transmit power via mutual resonance from a source resonator of the TX node to a target resonator of an RX node mounted in a washing container.

When the RX node mounted in the washing container is woken up by received power, a sensor of the RX node may sense any one or any combination of a weight of laundry in the washing container, a pressure of water flowing into the washing container, an internal temperature of the washing container, and an internal humidity of the washing container.

The RX node may determine, using a controller, a volume of water required to wash the laundry and a rotation velocity of a motor based on the weight of the laundry that is sensed by the sensor. For example, the rotation velocity of the motor may be set to be reduced as the weight of the laundry is increased. Additionally, the controller of the RX node may determine a degree of washing for the laundry based on the water pressure, the internal temperature, the internal humidity, and the any other parameter affecting the washing of the laundry. The RX node may transmit to the TX node information on an internal state of the washing container and the degree of washing. The TX node may display the information on the internal state of the washing container and the degree of washing on a display window of the washing machine.

In other examples, the RX node and TX node may also be mounted in various home appliances.

Figure 3:
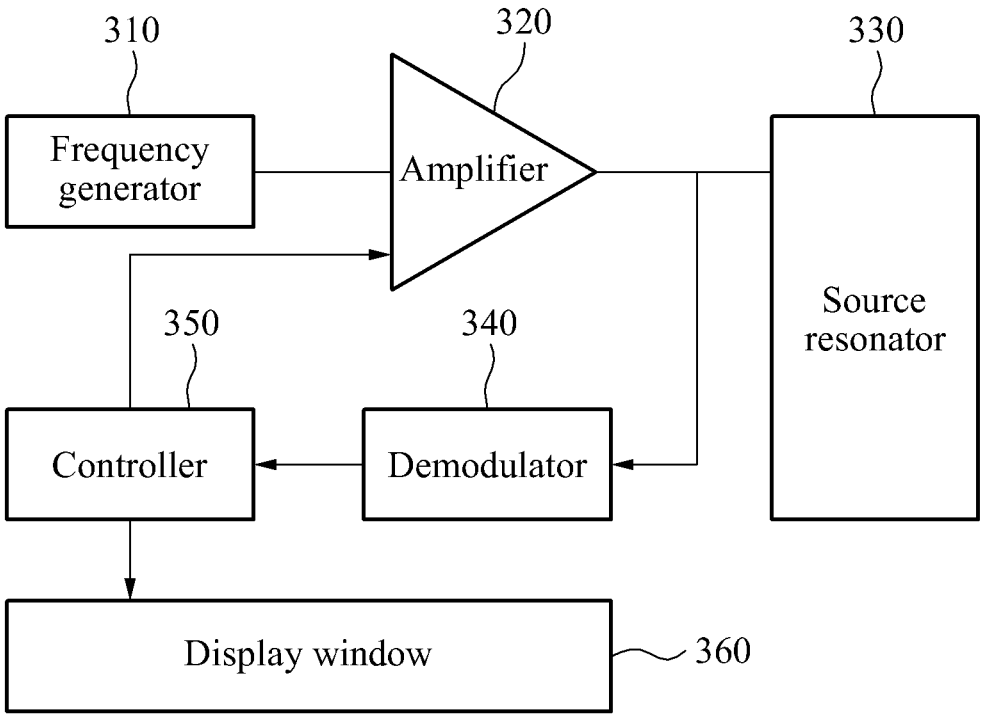
FIG. 3 illustrates an example of a transmission (TX) node using mutual resonance.

FIG. 3 illustrates an example of a TX node using mutual resonance. Referring to FIG. 3, the TX node includes a frequency generator 310, an amplifier 320, a source resonator 330, a demodulator 340, a controller 350, and a display window 360.

The frequency generator 310 generates a resonant frequency that enables mutual resonance to occur between the source resonator 330 and at least one target resonator. The source resonator 330 and the at least one target resonator may be designed to resonate at the same resonant frequency. The frequency generator 310 generates a signal having the resonant frequency.

The amplifier 320 amplifies the signal having the resonant frequency generated by the frequency generator 310 under control of the controller 350. For example, the amplifier 320 may amplify the signal having the resonant frequency to a power level required by an RX node. The power level required by the RX node may be determined by the controller 350.

The source resonator 330 transmits power via the mutual resonance with the at least one target resonator. The source resonator 330 is located within a distance from the at least one target resonator enabling the mutual resonance between the source resonator and the at least one target resonator to occur. For example, when the signal having the resonant frequency is amplified and the amplified signal is transmitted to the source resonator 330, the amplified signal may be transmitted to the at least one target resonator via the mutual resonance. The amplified signal received by the at least one target resonator may be supplied as power to elements of the at least one target resonator.

The demodulator 340 demodulates at least one data packet based on a change in a waveform of a signal received by the source resonator 330. The at least one data packet may be load-modulated by at least one RX node. The at least one RX node may be a single RX node, or a plurality of RX nodes. The at least one RX node may transmit a single data packet, or a plurality of data packets. For example, an RX node may modulate a data packet by changing an impedance of the RX node. When the impedance of the RX node is changed, a waveform of a signal received by the source resonator 330 is changed. The demodulator 340 may analyze the change in the waveform, and may demodulate the modulated data packet based on the change. In an example, the demodulator 340 may analyze a change in an amplitude of the waveform, and may demodulate the modulated data packet based on the change in the amplitude. In another example, the demodulator 340 may analyze a level of a peak value of the waveform, and may demodulate the modulated data packet based on the level of the peak value. In another example, the demodulator 340 may analyze a time interval in which a peak value of the waveform occurs, and may demodulate the modulated data packet based on the time interval.

The data packet may include, for example, identification information of an RX node, sensing information sensed by an RX node, information on a time required to transmit the data packet for each RX node, and data transmission waiting time information that is set to prevent RX nodes from colliding with each other during transmission of data packets.

The controller 350 may display on the display window 360 information acquired based on data of the data packet demodulated by the demodulator 340.

The controller 350 may determine an amount of power to be transmitted from the source resonator 330 based on a power level enabling a controller and a sensor to be woken up. The controller and the sensor may be included in each of the at least one RX node. Information on the power level may be set in advance in the controller 350.

The controller 350 may interrupt transmission of power using the source resonator 330 while receiving of data packets from all RX nodes is completed. When a predetermined period of time has elapsed after the transmission of power is interrupted, the controller 350 may restart the transmission of power.

An RX node may perform a sensing operation only when power is being received from a TX node. For example, when a supply of power from the TX node is interrupted, the RX node may not perform the sensing operation. In other words, the RX node may perform the sensing operation only when power is being received from the TX node based on control of the TX node, rather than continuously performing the sensing operation. Accordingly, an amount of energy consumed by the RX node may be reduced.

The display window 360 may display information supplied by the controller 350. The information may include, for example, information sensed by the RX node. The RX node may be used in various applications.

In an example, an RX node and a TX node using mutual resonance may be mounted in a kimchi refrigerator. In this example, the TX node and the RX node may be mounted in a door and a kimchi container of the kimchi refrigerator, respectively. The kimchi refrigerator may include a plurality of kimchi containers, and an RX node may be mounted in each of the plurality of kimchi containers.

The TX node may acquire, using the controller 350, aging information of kimchi in the kimchi container based on at least one data packet received from the at least one RX node, and may display the acquired aging information on the display window 360. While checking the information displayed on the display window 360, a user may raise, maintain, or lower a temperature of the kimchi container.

In another example, the RX node and the TX node using mutual resonance may be mounted in a washing machine. In this example, the TX node and the RX node may be mounted in a door and a washing container of the washing machine, respectively. The washing machine may include a plurality of washing containers, and an RX node may be mounted in each of the plurality of washing containers.

The TX node may acquire, using the controller 350, washing information of laundry in the washing container based on at least one data packet received from at least one RX node, and may display the acquired washing information on the display window 360.

In other examples, the RX node and TX node may be mounted in various home appliances.

Figure 4:
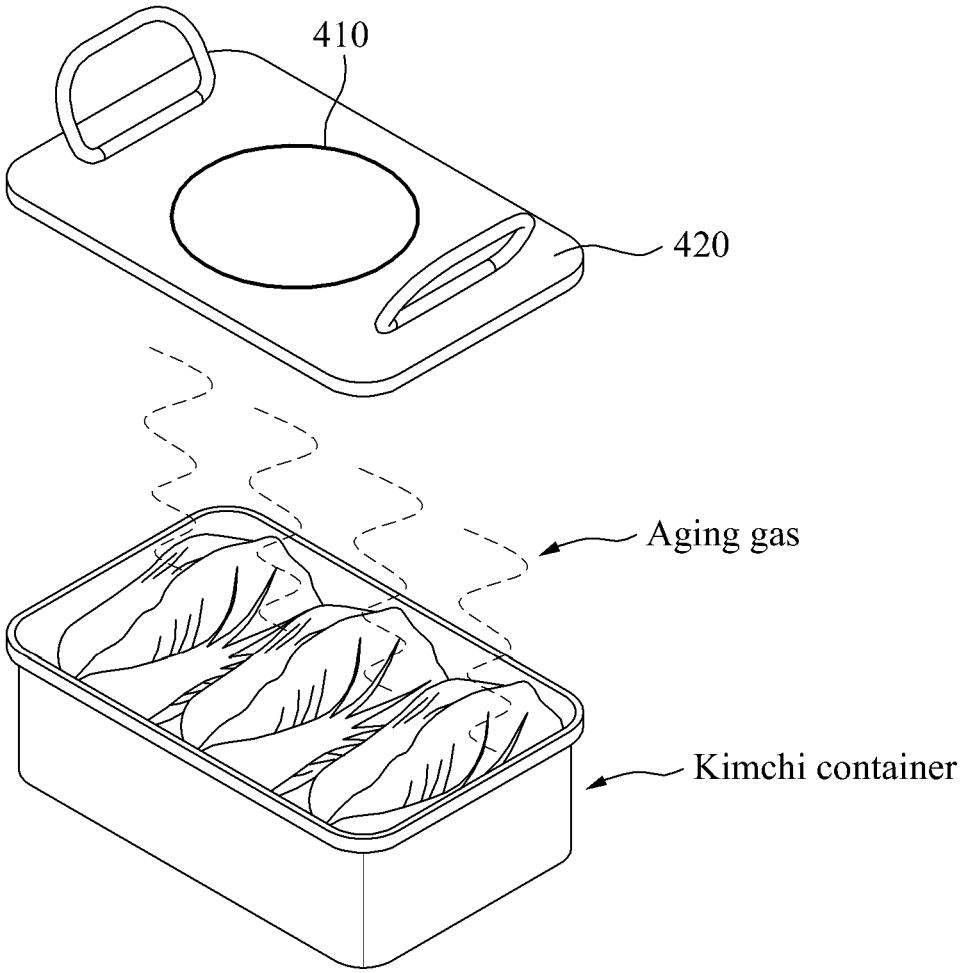
FIG. 4 illustrates an example of an application using an RX node using mutual resonance.

FIG. 4 illustrates an example of an application using an RX node using mutual resonance. Referring to FIG. 4, an RX node 410 is mounted in a lid 420 of a kimchi container. The RX node 410 may include a kimchi aging gas sensor. The kimchi aging gas sensor may be a pH sensor, and may sense an aging degree of kimchi by measuring an acidity in the air, namely a pH value.

In an example in which the RX node 410 is mounted in a lid of each of a plurality of kimchi containers, or in each of the kimchi containers, an acidity of kimchi in each of the kimchi containers may be independently measured.

Figure 5:
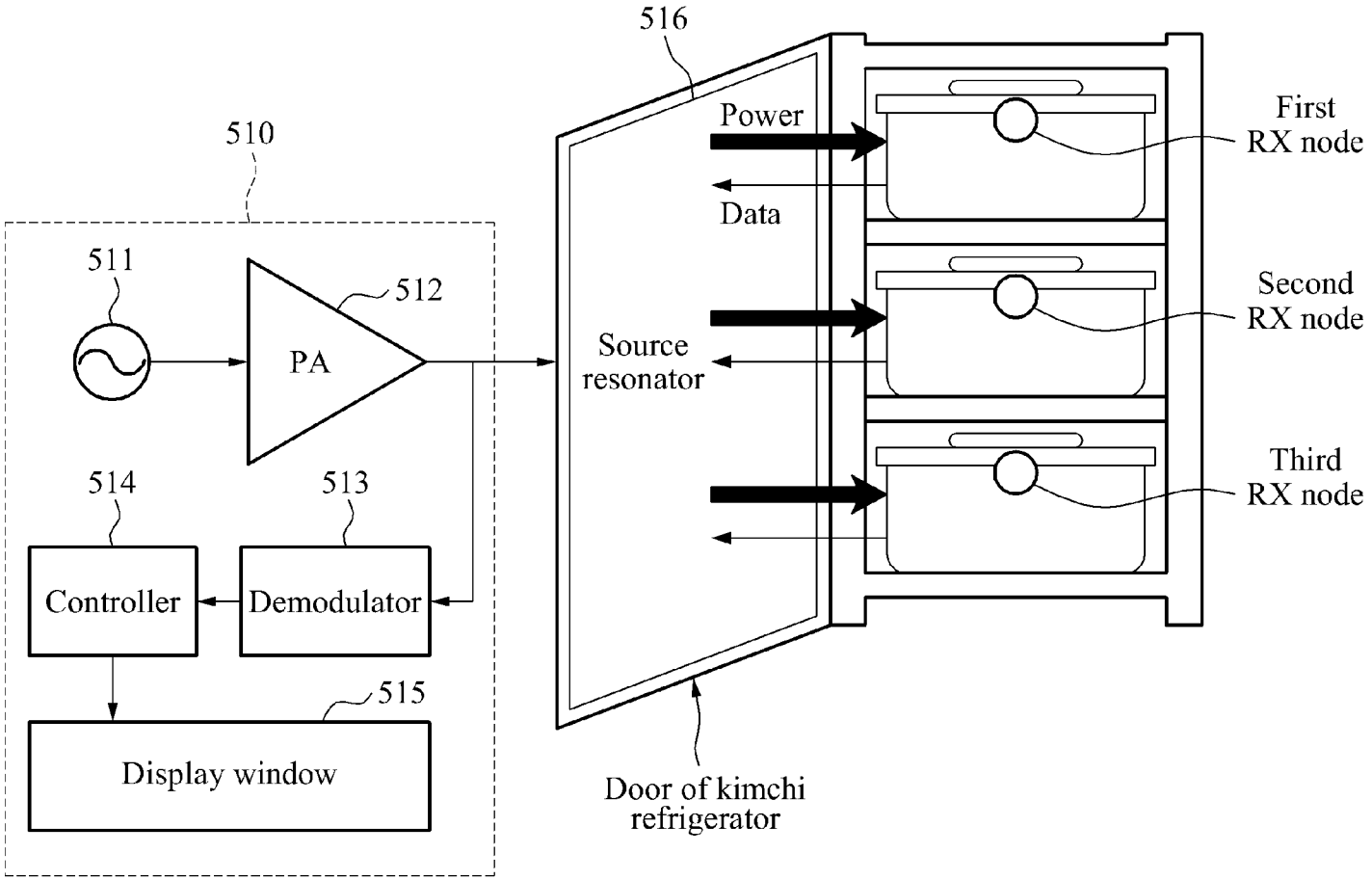
FIG. 5 illustrates an example of an application using a system for transceiving power and data using mutual resonance.

FIG. 5 illustrates an example of an application using a system for transceiving power and data using mutual resonance. Referring to FIG. 5, a TX node 510 is mounted in a door of a kimchi refrigerator. The TX node 510 includes a frequency generator 511, a PA 512, a demodulator 513, a controller 514, a display window 515, and a source resonator 516.

The frequency generator 511 generates a signal having a resonant frequency that enables mutual resonance to occur between the source resonator 516 and a target resonator. For example, mutual resonance may occur between the source resonator 516 an a target resonator of a first RX node, a target resonator of a second RX node, and a target resonator of a third RX node.

The PA 512 amplifies the signal generated by the frequency generator 511 to a power level required to wake up the first RX node through the third RX node and charge the first RX node through the third RX node.

The demodulator 513 demodulates data packets received from the first RX node through the third RX node. The data packets may be modulated using load modulation, and the demodulator 513 may analyze a change in a waveform of a signal received by the source resonator 516, and demodulate the modulated data packets based on the change in the waveform.

The controller 514 determines an amount of power required to be amplified by the PA 512 based on information demodulated by the demodulator 513. The controller 514 displays the information demodulated by the demodulator 513 on the display window 515.

The source resonator 516 may be the same size as the door of the kimchi refrigerator, or a plurality of small-sized source resonators may be provided.

The first RX node, the second RX node, and the third RX node are mounted in a first container, a second container, and a third container of the kimchi refrigerator, respectively.

When power is received from the TX node 510, the first RX node through the third RX node are substantially simultaneously woken up. Each of the first RX node through the third RX node includes a control module and a kimchi aging gas sensor. Each of the first RX node through the third RX node may transmit aging information of kimchi to the TX node 510 sequentially based on a point in time at which the first RX node through the third RX node are woken up. The aging information is measured by the kimchi aging gas sensor of each of the first kimchi container through the third kimchi container.

The controller 514 in the TX node 510 acquires aging information of kimchi in each of the first kimchi container through the third kimchi container, and a temperature of each of the first kimchi container through the third kimchi container, based on the data packets received from the first RX node through the third RX node. Additionally, the controller 514 may display the acquired aging information and the acquired temperature on the display window 515.

For example, when a unique ID is assigned to each of the first kimchi container through the third kimchi container, the TX node 510 may individually manage the received information.

Since an RX node needs to be attached to a kimchi container, it is difficult to use a battery to power the RX node due to a problem, for example, a humidity, a temperature, and the like. Accordingly, a sensor of an RX node may receive power in real time using a wireless power transmission technology. A target resonator of each RX node may receive AC power from the source resonator 516. A rectifier of each RX node may rectify the received AC power to DC power, and a DC/DC converter of each RX node may convert a voltage level of the rectified DC power to a rated voltage level of a control module and a rated voltage level of the sensor. Data measured by the sensor may be modulated by a load modulation scheme, and the modulated data may be transmitted to the source resonator 516.

Figure 6:
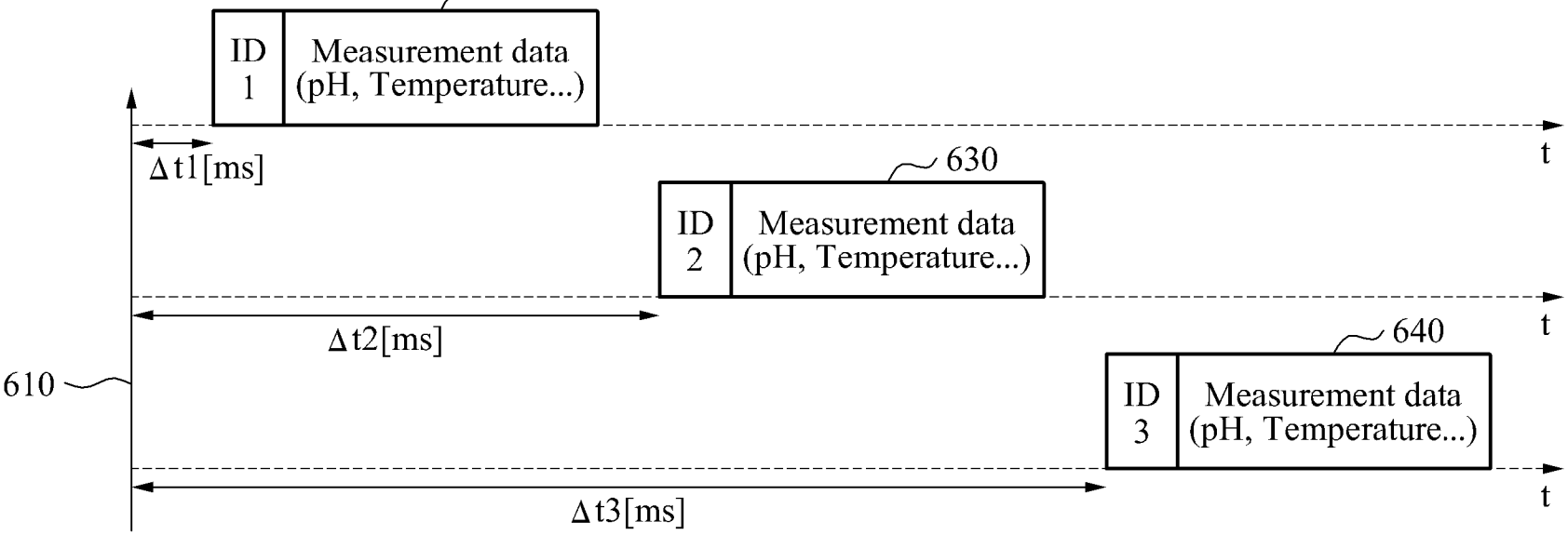
FIG. 6 illustrates an example of transmission of data packets in RX nodes using mutual resonance.

FIG. 6 illustrates an example of transmission of data packets in RX nodes using mutual resonance. Referring to FIG. 6, the first RX node through the third RX node of FIG. 5 recognize a point in time 610 at which the first RX node through the third RX node are woken up by receiving power from the TX node 510 of FIG. to be a synchronization point in time of transmission of data packets.

To prevent data packets transmitted by the first RX node through the third RX node from colliding with each other in a TX node, a data transmission waiting time is set for each of the RX nodes.

Each of the RX nodes forms data packet information including unique identification information of the RX node and a unique data transmission waiting time $\Delta t$ of the RX node.

In an example in which each RX node receives power, a control module and a sensor of each RX node may be woken up. When the control module and the sensor are woken up, the sensor may measure information, for example, an internal acidity and an internal temperature of a kimchi container, and transmit the measured information to the control module.

The point in time 610 at which a control module of each of the first RX node through the third RX node is woken up may be used as a criterion of time synchronization between the first RX node, the second RX node, and the third RX node. The point in time 610 may be the same or substantially the same as a point in time at which the first RX node, the second RX node, and the third RX node receives power. The control module may transmit identification information of the control module and the measured data to a TX node after a unique data transmission waiting time $\Delta t$, and thus it is possible to prevent data transmitted by each RX node from colliding with each other.

In FIG. 6, in the first RX node, $\Delta t1$ in millisecond (ms) may be set. For example, when $\Delta t1$ has elapsed from the point in time 610, the first RX node may transmit, to the TX node, a data packet 620 including identification information ID1 and measurement data. In the second RX node, $\Delta t2$ in ms may be set to be longer than a sum of $\Delta t1$ and T_Data in ms ($\Delta t2$[ms] $>\Delta t1$[ms]+T_Data[ms]). T_Data indicates a time required to complete transmission of the data packet 620. A value of T_Data may be determined based on the data packet 620, a data packet 630, and a data packet 640, or may be set to be the same. For example, when Δt2 has elapsed from the point in time 610, the second RX node may transmit, to the TX node, the data packet 630 including identification information ID2 and measurement data. Similarly, in the third RX node, Δt3 in ms may be set to be longer than a sum of Δt2 and T_Data (Δt3[ms]>Δt2[ms]+T_Data[ms]). For example, when Δt3 has elapsed from the point in time 610, the third RX node may transmit, to the TX node, the data packet 640 including identification information ID3 and measurement data.

Thus, the data packets 620 through 640 may be transmitted to the TX node at different times, and accordingly the TX node may separately demodulate the data packets 620 through 640.

The TX node may share information on data transmission waiting times Δt1, Δt2, and Δt3 with each of the RX nodes in advance.

Figure 7:
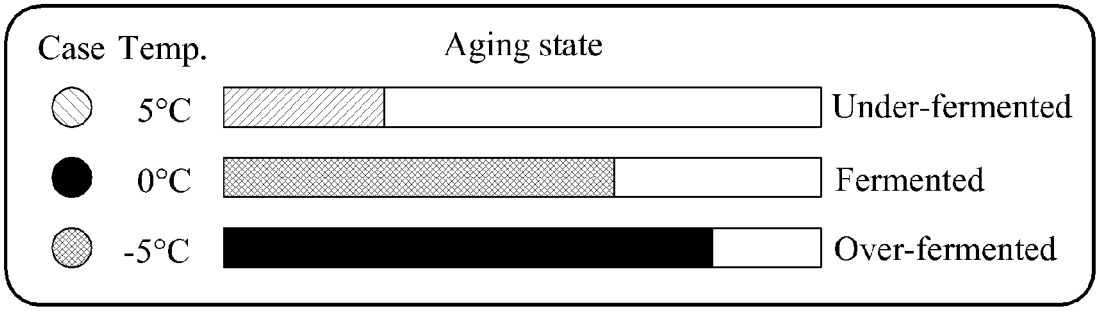
FIG. 7 illustrates an example of information displayed on a display window in a TX node using mutual resonance.

FIG. 7 illustrates an example of information displayed on a display window in a TX node using mutual resonance. Referring to FIG. 7, the TX node may display, on the display window, a temperature of each kimchi container, and an aging state of kimchi in each kimchi container. For example, a user may control a temperature of a kimchi refrigerator by checking the aging state of the kimchi.

Figure 8:
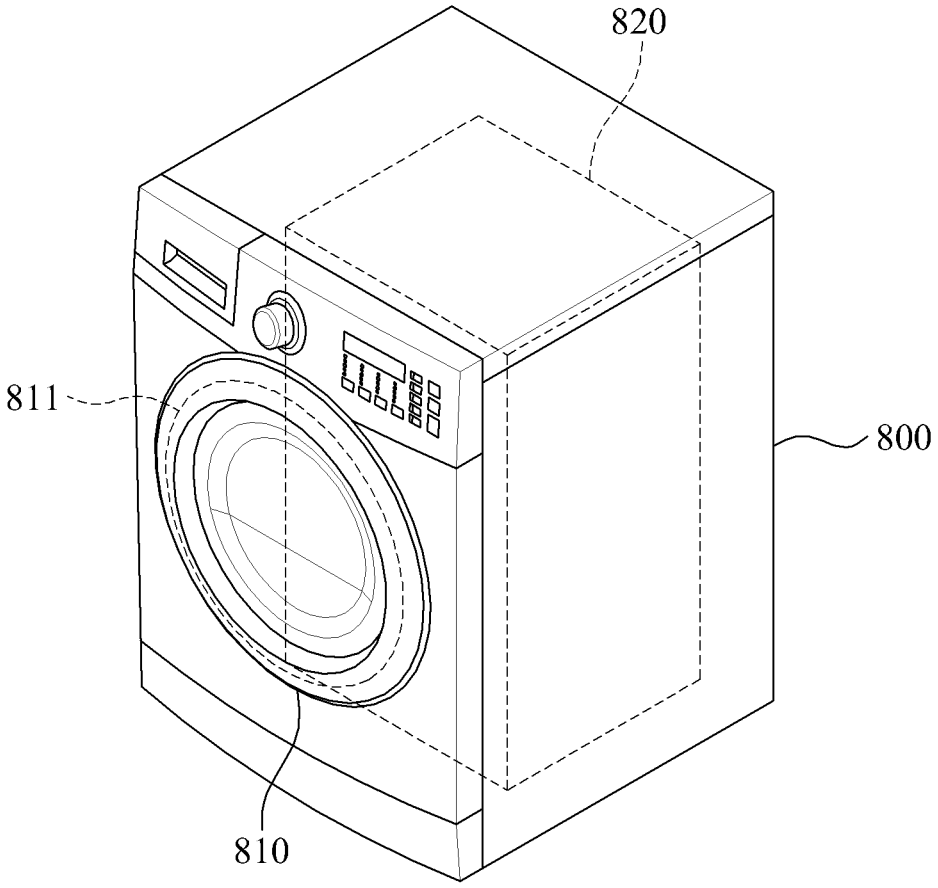
FIG. 8 illustrates another example of an application using a system for transceiving power and data using mutual resonance.

FIG. 8 illustrates another example of an application using a system for transceiving power and data using mutual resonance. Referring to FIG. 8, a TX node 811 is be mounted in a door 810 of a washing machine 800. The TX node 811 may include a frequency generator, a PA, a demodulator, a controller, a display window, and a source resonator similar to the TX node of FIG. 3.

An RX node (not illustrated) may be mounted in a washing container 820. The RX node may include a target resonator, a rectifier, a DC/DC converter, a sensor, a controller, and a modulator similar to the RX node of FIG. 2. The sensor may be woken up by received power, and may sense any one or any combination of a weight of laundry in the washing container 820, a pressure of water flowing into the washing container 820, and an internal temperature of the washing container 820, and an internal humidity of the washing container 820.

The controller may determine a capacity of water required to wash the laundry and a rotation velocity of a motor based on the weight of the laundry sensed by the sensor. For example, the controller may reduce the rotation velocity of the motor as the weight of the laundry increases. Additionally, the controller may determine a degree of washing for the laundry based on the pressure of water, the internal temperature, and the internal humidity that are sensed by the sensor. The RX node may transmit to the TX node 811 information on an internal state of the washing container 820 and the degree of washing. The TX node 811 may display the information on the internal state of the washing container 820 and the degree of washing on the display window.

The TX node 811 may acquire using the controller washing information of laundry in the washing container 820 based on at least one data packet received from at least one RX node, and may display the acquired washing information on the display window.

Figure 9:
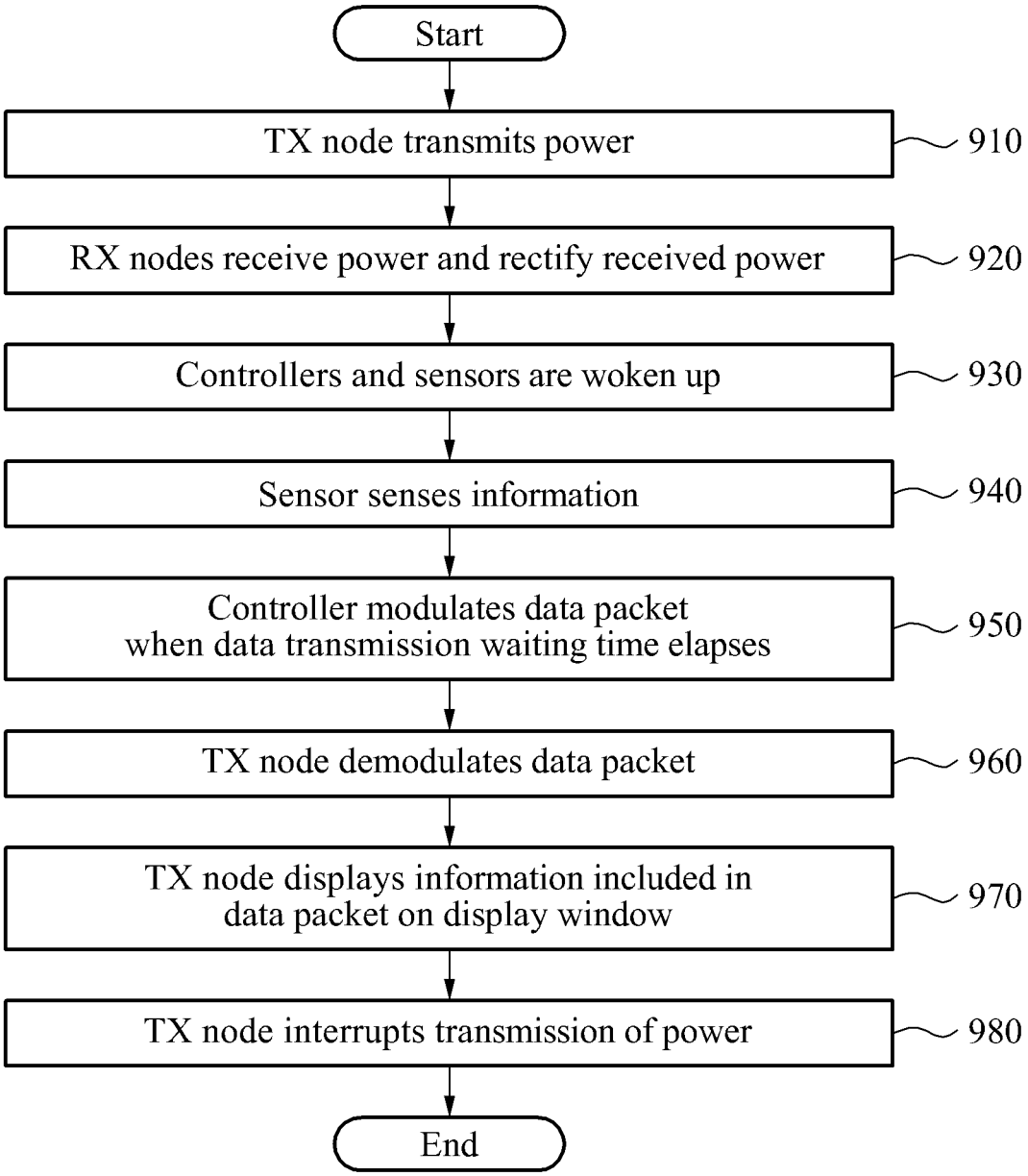
FIG. 9 illustrates an example of a method of transceiving power and data using mutual resonance.

FIG. 9 illustrates an example of a method of transceiving power and data using mutual resonance. Referring to FIG. 9, in 910, a TX node transmits power using a source resonator via mutual resonance between the source resonator and a target resonator. The target resonator may be mounted in each of a plurality of RX nodes. For example, the TX node may transmit power using the source resonator to target resonators.

In 920, the plurality of RX nodes receive power using the target resonators in the plurality of RX nodes, and rectify the received power.

In 930, a controller and a sensor included in each of the plurality of RX nodes are woken up by the received power. When the system starts operating, the TX node may transmit power at a power level that enables controllers and sensors included in the plurality of RX nodes to be woken up.

In 940, the sensor in each of the plurality of RX nodes senses information. For example, when a sensor of an RX node is woken up, a sensing operation may be performed.

In 950, the controller in each of the plurality of RX nodes modulates a data packet using a load modulation scheme when a data transmission waiting time elapses. The load-modulated data packet is transmitted from the target resonator to the source resonator via the mutual resonance.

In 960, the TX node receives a modulated data packet received from each of the plurality of RX nodes, and demodulates the modulated data packet based on a change in a waveform of a signal received by the source resonator.

In 970, the TX node displays information included in the demodulated data packet on a display window.

When data packets have been received from all of the plurality of RX nodes, the TX node interrupts transmission of power to the plurality of RX nodes in 980.

Figure 10A:
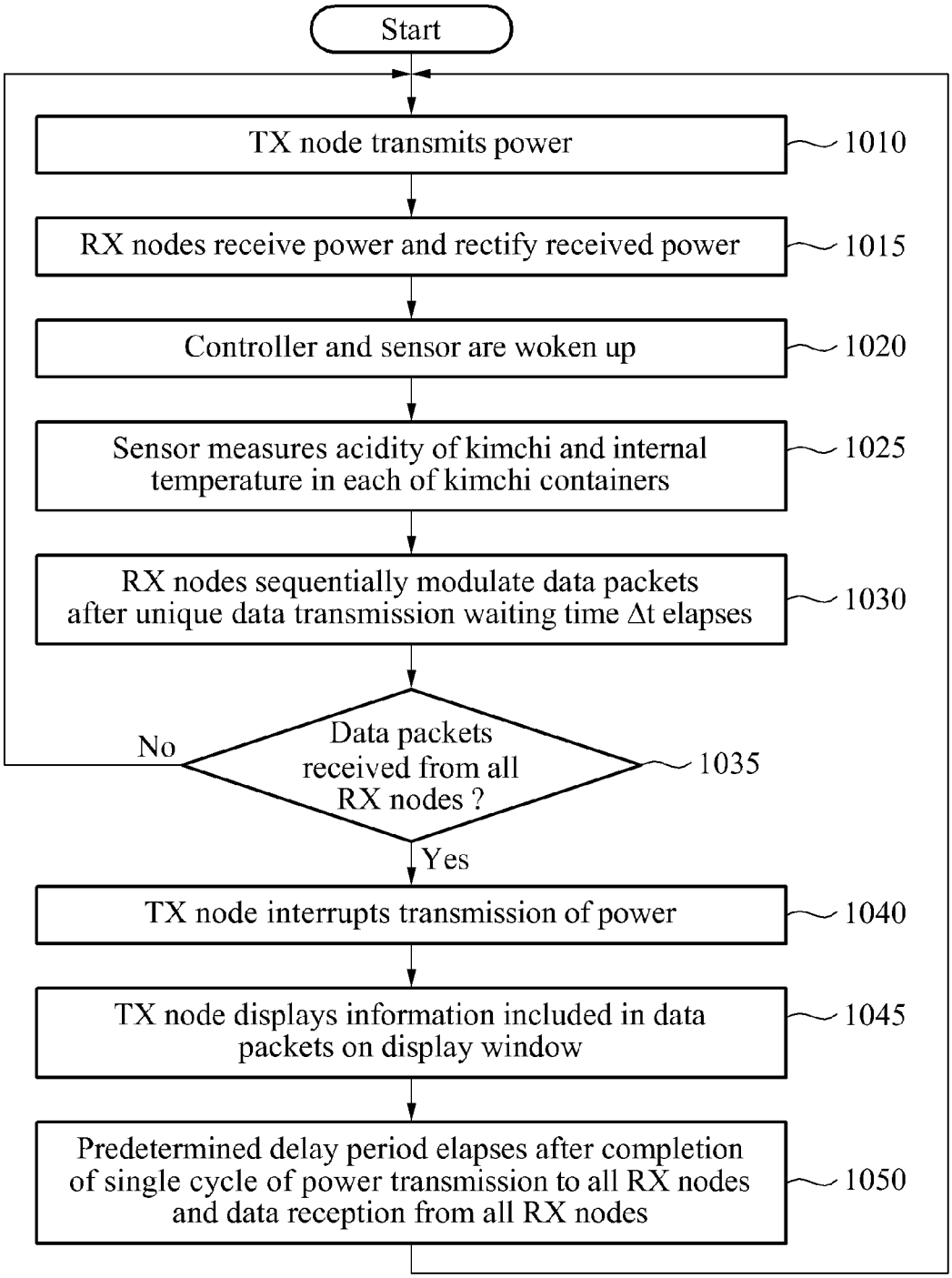
FIG. 10A illustrates another example of a method of transceiving power and data using mutual resonance.

FIG. 10A illustrates another example of a method of transceiving power and data using mutual resonance. Referring to FIG. 10A, in 1010, the TX node transmits power to a plurality of RX nodes, for example RX nodes 1, 2, 3, and 4. The TX node includes a source resonator, and each of the plurality of RX nodes includes a target resonator. The source resonator and the target resonator mutually resonate at the same resonant frequency. When mutual resonance occurs, power stored in the source resonator is transmitted to the target resonator.

In 1015, the plurality of RX nodes receive the power from the TX node, and rectify the received power. For example, the plurality of RX nodes may receive AC power, and rectify the received AC power to DC power.

In 1020, a controller and a sensor included in each of the plurality of RX nodes are woken up when the rectified power is supplied. For example, when wake-up power is supplied to the controller and the sensor, the controller and the sensor may start operating.

In 1025, the sensor in each of the plurality of RX nodes performs a sensing operation. For example, the RX nodes 1, 2, 3, and 4 may be mounted in a first kimchi container, a second kimchi container, a third kimchi container, and a fourth kimchi container, respectively. In this example, the sensor may measure an acidity from gas generated from kimchi in each of the first kimchi container through the fourth kimchi container. Additionally, the sensor may measure an internal temperature of each of the first kimchi container through the fourth kimchi container.

In 1030, the plurality of RX nodes sequentially modulate data packets using a load modulation scheme when a unique data transmission waiting time Δt set for each of the plurality of RX nodes elapses. The load-modulated data packets are transmitted from the target resonator to the source resonator via the mutual resonance.

In 1035, the TX node determines whether the data packets have been received from all of the plurality of RX nodes. For example, the TX node may determine whether four data packets have been received from the RX nodes 1, 2, 3, and 4.

If a result of the determination in 1035 is that the data packets have been received from all of the plurality of RX nodes, the TX node interrupts transmission of power to the RX nodes 1, 2, 3, and 4 in 1040. Otherwise, the TX node continues to transmit power to the RX nodes 1, 2, 3, and 4 in 1010.

In 1045, the TX node displays information included in the data packets received from the RX nodes on a display window. Each of the data packets may include, for example, an acidity of kimchi in each kimchi container, an internal temperature of each kimchi container, and other information on the kimchi and the kimchi container.

When a predetermined delay period elapses after completion of a single cycle of power transmission to all of the RX nodes and data reception from all of the RX nodes in 1050, the TX node restarts transmission of power to the RX nodes in 1010.

According to various examples, an aging gas sensor of an RX node may not need to monitor data continuously or in real time. Accordingly, a TX node may transmit power in a single cycle to save energy, and a sensor of the RX node may measure information and transmit a measurement result to the TX node. The measurement result may be displayed on a display window of the TX node.

The TX node may transmit power at a power level that enables both a controller and a sensor of the RX node to be woken up. The TX node may continue to transmit power until data transmission of an RX node corresponding to a longest data transmission waiting time Δt is completed. When the data transmission is completed, the TX node may interrupt transmission of the power.

Figure 10B:
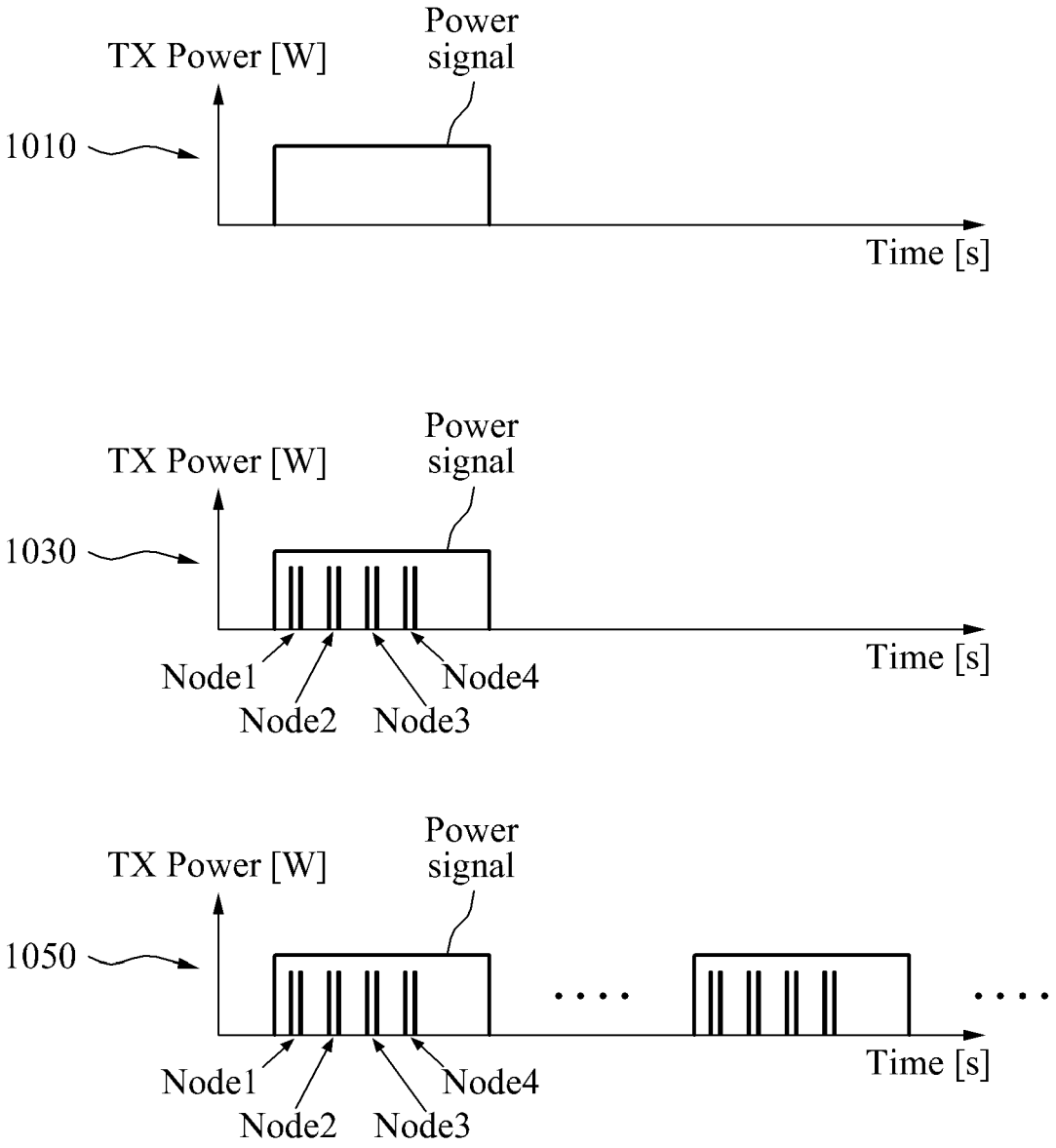
FIG. 10B illustrates an example of an amount of power measured by a TX node using mutual resonance in various operations of the method of FIG. 10A.

FIG. 10B illustrates an example of an amount of power measured by the TX node in operations 1010, 1030, and 1050 of the method of FIG. 10A. Referring to 1010 of FIG. 10B, when the system starts operating, the TX node transmits wake-up power. An amount of wake-up power may correspond to an amount of power used to wake up both a controller and a sensor included in an RX node.

Referring to 1030 of FIG. 10B, when information sensed by each of the RX nodes is load-modulated, a waveform of a signal received by the source resonator is changed. The TX node demodulates the information sensed by each of the RX nodes by analyzing a change in the waveform.

Referring to 1050 of FIG. 10B, the TX node interrupts transmission of power when the data packets have been received from all of the RX nodes. When a predetermined delay period elapses, the TX node restarts transmission of the power in 1010.

According to various examples, by using a TX node and an RX node using mutual resonance, it is possible to independently measure a temperature and acidity of kimchi in each kimchi container. Since monitoring of each kimchi container is possible, it is possible to check a refrigeration state of each compartment of a kimchi refrigerator in which each kimchi container is located, and maintain kimchi in a desired aging state by controlling a temperature of each kimchi container of the kimchi refrigerator.

Additionally, according to various examples, by using a TX node and an RX node using mutual resonance, it is possible to configure an RX node without using a battery, and transceive data using an in-band communication scheme using load modulation.

Furthermore, according to various examples, it is possible to configure a data packet so that the data packet may be transmitted with unique identification information, namely IDs, and a unique data transmission waiting time Δt. The unique identification information and the unique data transmission waiting time Δt may be used to prevent RX nodes from colliding with each other.

Moreover, according to various examples, by using a TX node and an RX node using mutual resonance, it is possible for the TX node to transmit power in a single cycle to save energy, since there is no need for a sensor of the RX node to monitor data continuously or in real time. For example, a single cycle may correspond to a few seconds, or a few minutes.

In the following description of FIGS. 11A through 13B, unless otherwise indicated, the term "resonator" may refer to both a source resonator and a target resonator.

The resonators of FIGS. 11A through 13B may be used as the resonators of FIGS. 1 through 10B.

Figure 11A:
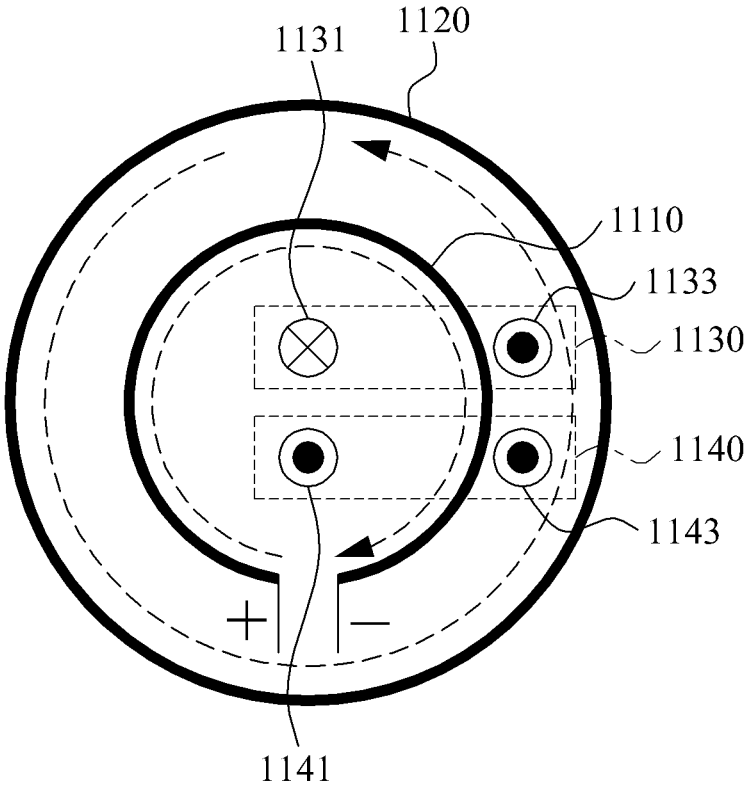
FIGS. 11A and 11B illustrate examples of a distribution of a magnetic field in a feeder and a resonator.
Figure 11B:
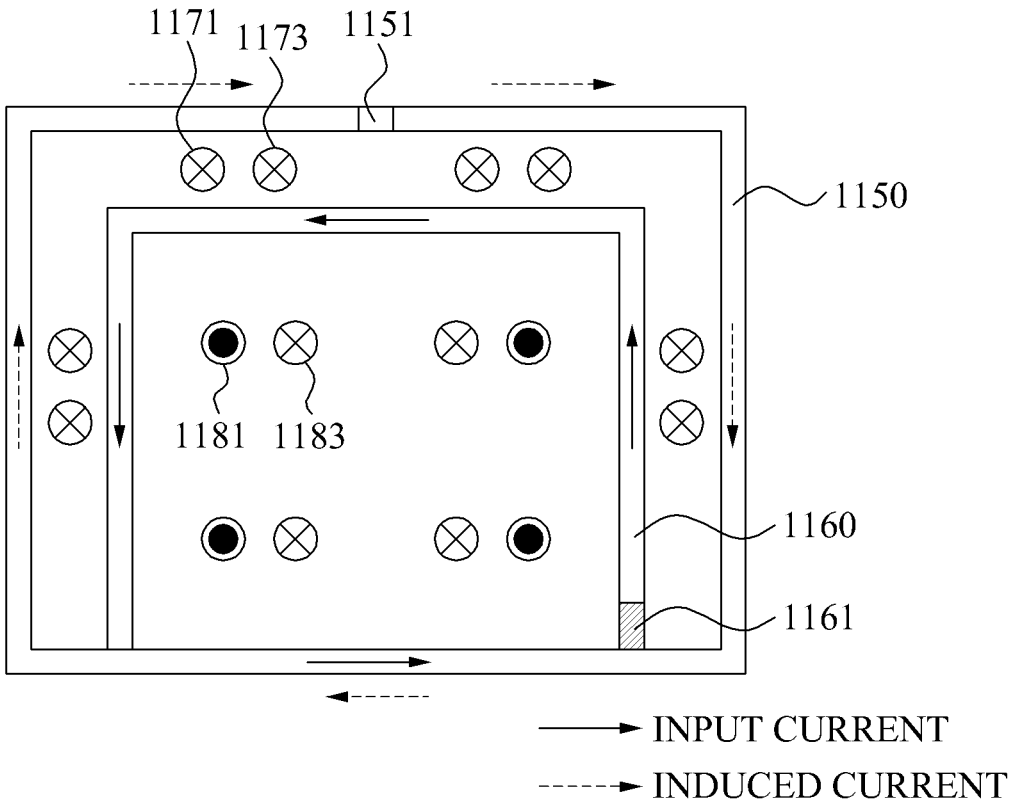

FIGS. 11A and 11B illustrate examples of a distribution of a magnetic field in a feeder and a resonator of a wireless power transmitter. When a resonator receives power supplied through a separate feeder, magnetic fields are generated in both the feeder and the resonator.

FIG. 11A illustrates an example of a structure of a wireless power transmitter in which a feeder 1110 and a resonator 1120 do not have a common ground. Referring to FIG. 11A, when an input current flows into the feeder 1110 through a terminal labeled "+" and out of the feeder 1110 through a terminal labeled "−", a magnetic field 1130 is generated by the input current. A direction 1131 of the magnetic field 1130 inside the feeder 1110 is into the plane of FIG. 11, and is opposite to a direction 1133 of the magnetic field 1130 outside the feeder 1110. The magnetic field 1130 generated by the feeder 1110 induces a current to flow in the resonator 1120. The direction of the induced current in the resonator 1120 is opposite to a direction of the input current in the feeder 1110 as indicated by the dashed lines with arrowheads in FIG. 11A.

The induced current in the resonator 1120 generates a magnetic field 1140. Directions of the magnetic field 1140 generated by the resonator 1120 are the same at all positions inside the resonator 1120, and are out of the plane of FIG. 11A. Accordingly, a direction 1141 of the magnetic field 1140 generated by the resonator 1120 inside the feeder 1110 is the same as a direction 1143 of the magnetic field 1140 generated by the resonator 1120 outside the feeder 1110.

Consequently, when the magnetic field 1130 generated by the feeder 1110 and the magnetic field 1140 generated by the resonator 1120 are combined, a strength of the total magnetic field decreases inside the feeder 1110, but increases outside the feeder 1110. In an example in which power is supplied to the resonator 1120 through the feeder 1110 configured as illustrated in FIG. 11A, the strength of the total magnetic field decreases in the center of the resonator 1120, but increases outside the resonator 1120. In another example in which a magnetic field is randomly or not uniformly distributed in the resonator 1120, it may be difficult to perform impedance matching since an input impedance may frequently vary. Additionally, when the strength of the total magnetic field increases, a wireless power transmission efficiency increases. Conversely, when the strength of the total magnetic field decreases, the wireless power transmission efficiency decreases. Accordingly, the wireless power transmission efficiency is reduced on average when the magnetic field is randomly or not uniformly distributed in the resonator 1120 compared to when the magnetic field is uniformly distributed in the resonator 1120.

FIG. 11B illustrates an example of a structure of a wireless power transmission apparatus in which a resonator 1150 and a feeder 1160 have a common ground. The resonator 1150 includes a capacitor 1151. The feeder 1160 receives a radio frequency (RF) signal via a port 1161. When the RF signal is input to the feeder 1160, an input current is generated in the feeder 1160. The input current flowing in the feeder 1160 generates a magnetic field, and a current is induced in the resonator 1150 by the magnetic field. Additionally, another magnetic field is generated by the induced current flowing in the resonator 1150. In this example, a direction of the input current flowing in the feeder 1160 is opposite to a direction of the induced current flowing in the resonator 1150. Accordingly, in a region between the resonator 1150 and the feeder 1160, a direction 1171 of the magnetic field generated by the input current is the same as a direction 1173 of the magnetic field generated by the induced current, and thus the strength of the total magnetic field increases in the region between the resonator 1150 and the feeder 1160. Conversely, inside the feeder 1160, a direction 1181 of the magnetic field generated by the input current is opposite to a direction 1183 of the magnetic field generated by the induced current, and thus the strength of the total magnetic field decreases inside the feeder 1160. Therefore, the strength of the total magnetic field decreases in the center of the resonator 1150, but increases outside the resonator 1150.

An input impedance may be adjusted by adjusting an internal area of the feeder 1160. The input impedance refers to an impedance viewed in a direction from the feeder 1160 to the resonator 1150. When the internal area of the feeder 1160 is increased, the input impedance is increased. Conversely, when the internal area of the feeder 1160 is decreased, the input impedance is decreased. However, if the magnetic field is randomly or not uniformly distributed in the resonator, a value of the input impedance may vary based on a location of a target device even if the internal area of the feeder 1160 has been adjusted to adjust the input impedance to match an output impedance of a power amplifier for a specific location of the target device. Accordingly, a separate matching network may be required to match the input impedance to the output impedance of the power amplifier. For example, when the input impedance is increased, a separate matching network may be used to match the increased input impedance to a relatively low output impedance of the power amplifier.

Figure 12A:
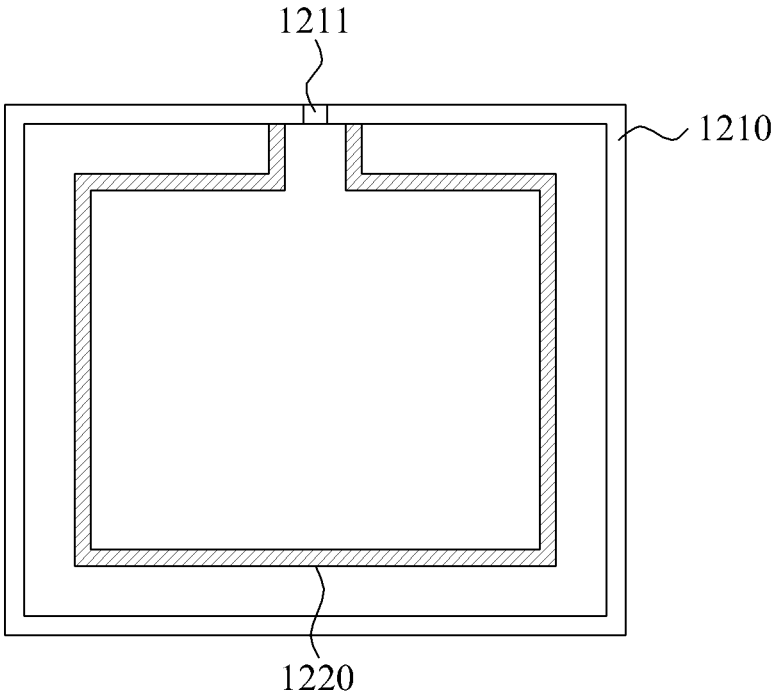
FIGS. 12A and 12B illustrate an example of a wireless power transmitter.
Figure 12B:
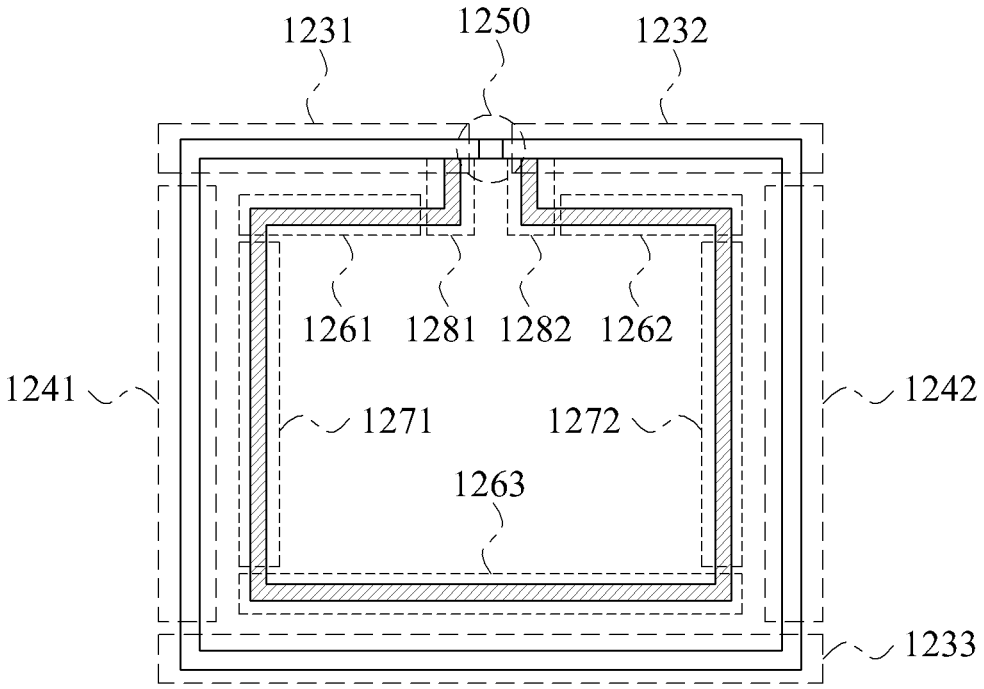

FIGS. 12A and 12B illustrate an example of a resonator and a feeder of a wireless power transmission apparatus. Referring to FIG. 12A, the wireless power transmission apparatus includes a resonator 1210 and a feeder 1220. The resonator 1210 includes a capacitor 1211. The feeder 1220 is electrically connected to both ends of the capacitor 1211.

FIG. 12B illustrates in greater detail a structure of the resonator and the feeder of the wireless power transmission apparatus of FIG. 12A. The resonator 1210 includes a first transmission line (not identified by a reference numeral in FIG. 12B, but formed by various elements in FIG. 12B as discussed below), a first conductor 1241, a second conductor 1242, and at least one capacitor 1250.

The capacitor 1250 is inserted in series between a first signal conducting portion 1231 and a second signal conducting portion 1232, causing an electric field to be concentrated in the capacitor 1250. Generally, a transmission line includes at least one conductor in an upper portion of the transmission line, and may also include at least one conductor in a lower portion of the transmission line. A current may flow through the at least one conductor disposed in the upper portion of the transmission line, and the at least one conductor disposed in the lower portion of the transmission line may be electrically grounded. In this example, a conductor disposed in an upper portion of the first transmission line in FIG. 12B is separated into two portions that will be referred to as the first signal conducting portion 1231 and the second signal conducting portion 1232. A conductor disposed in a lower portion of the first transmission line in FIG. 12B will be referred to as a first ground conducting portion 1233.

As illustrated in FIG. 12B, the resonator 1210 has a generally two-dimensional (2D) structure. The first transmission line includes the first signal conducting portion 1231 and the second signal conducting portion 1232 in the upper portion of the first transmission line, and includes the first ground conducting portion 1233 in the lower portion of the first transmission line. The first signal conducting portion 1231 and the second signal conducting portion 1232 are disposed to face the first ground conducting portion 1233. A current flows through the first signal conducting portion 1231 and the second signal conducting portion 1232.

One end of the first signal conducting portion 1231 is connected to one end of the first conductor 1241, the other end of the first signal conducting portion 1231 is connected to one end of the capacitor 1250, and the other end of the first conductor 1241 is connected to one end of the first ground conducting portion 1233. One end of the second signal conducting portion 1232 is connected to one end of the second conductor 1242, the other end of the second signal conducting portion 1232 is connected to the other end of the capacitor 1250, and the other end of the second conductor 1242 is connected to the other end of the first ground conducting portion 1233. Accordingly, the first signal conducting portion 1231, the second signal conducting portion 1232, the first ground conducting portion 1233, the first conductor 1241, the second conductor 1242, and the capacitor 1250 are connected to each other, causing the resonator 1210 to have an electrically closed loop structure. The term "loop structure" includes a polygonal structure, a circular structure, a rectangular structure, and any other geometrical structure that is closed, i.e., a geometrical structure that does not have any opening in its perimeter. The expression "having a loop structure" indicates a structure that is electrically closed.

The capacitor 1250 may be inserted into an intermediate portion of the first transmission line. In the example in FIG. 12B, the capacitor 1250 is inserted into a space between the first signal conducting portion 1231 and the second signal conducting portion 1232. The capacitor 1250 may be configured as a lumped element, a distributed element capacitor, or any other type of capacitor known to one of ordinary skill in the art. For example, a distributed element capacitor may include zigzagged conductor lines and a dielectric material having a relatively high permittivity disposed between the zigzagged conductor lines.

The capacitor 1250 inserted into the first transmission line may cause the resonator 1210 to have a characteristic of a metamaterial. A metamaterial is a material having a predetermined electrical property that is not found in nature, and thus may have an artificially designed structure. All materials existing in nature have a magnetic permeability and a permittivity. Most materials may have a positive magnetic permeability and/or a positive permittivity.

For most materials, a right-hand rule may be applied to an electric field, a magnetic field, and a Poynting vector, so the materials may be referred to as right-handed handed materials (RHMs). However, a metamaterial that has a magnetic permeability and/or a permittivity that is not found in nature may be classified into an epsilon negative (ENG) material, a mu negative (MNG) material, a double negative (DNG) material, a negative refractive index (NRI) material, a left-handed (LH) material, and any other metamaterial classification known to one of ordinary skill in the art based on a sign of the magnetic permeability of the metamaterial and a sign of the permittivity of the metamaterial.

If the capacitor 1250 is lumped element capacitor and a capacitance of the capacitor 1250 is appropriately determined, the resonator 1210 may have a characteristic of a metamaterial. If the resonator 1210 is caused to have a negative magnetic permeability by appropriately adjusting the capacitance of the capacitor 1250, the resonator 1210 may also be referred to as an MNG resonator. Various criteria may be applied to determine the capacitance of the capacitor 1250. For example, the various criteria may include a criterion for enabling the resonator 1210 to have the characteristic of the metamaterial, a criterion for enabling the resonator 1210 to have a negative magnetic permeability at a target frequency, a criterion for enabling the resonator 1210 to have a zeroth order resonance characteristic at the target frequency, and any other suitable criterion. Based on any one or any combination of the aforementioned criteria, the capacitance of the capacitor 1250 may be appropriately determined.

The resonator 1210, hereinafter referred to as the MNG resonator 1210, may have a zeroth order resonance characteristic of having a resonant frequency when a propagation constant is "0". When the resonator 1210 has a zeroth order resonance characteristic, the resonant frequency is independent of a physical size of the MNG resonator 1210. By changing the capacitance of the capacitor 1250, the resonant frequency of the MNG resonator 1210 may be changed without changing the physical size of the MNG resonator 1210.

In a near field, the electric field is concentrated in the capacitor 1250 inserted into the first transmission line, causing the magnetic field to become dominant in the near field. The MNG resonator 1210 may have a relatively high Q-factor when the capacitor 1250 is lumped element capacitor, thereby increasing a wireless power transmission efficiency. The O-factor indicates a level of an ohmic loss or a ratio of a reactance with respect to a resistance in the wireless power transmission. As will be understood by one of ordinary skill in the art, the wireless power transmission efficiency will increase as the O-factor increases.

Although not illustrated in FIG. 12B, a magnetic core passing through the MNG resonator 1210 may be provided to increase a wireless power transmission distance.

Referring to FIG. 12B, the feeder 1220 includes a second transmission line (not identified by a reference numeral in FIG. 12B, but formed by various elements in FIG. 12B as discussed below), a third conductor 1271, a fourth conductor 1272, a fifth conductor 1281, and a sixth conductor 1282.

The second transmission line includes a third signal conducting portion 1261 and a fourth signal conducting portion 1262 in an upper portion of the second transmission line, and includes a second ground conducting portion 1263 in a lower portion of the second transmission line. The third signal conducting portion 1261 and the fourth signal conducting portion 1262 are disposed to face the second ground conducting portion 1263. A current flows through the third signal conducting portion 1261 and the fourth signal conducting portion 1262.

One end of the third signal conducting portion 1261 is connected to one end of the third conductor 1271, the other end of the third signal conducting portion 1261 is connected to one end of the fifth conductor 1281, and the other end of the third conductor 1271 is connected to one end of the second ground conducting portion 1263. One end of the fourth signal conducting portion 1262 is connected to one end of the fourth conductor 1272, the other end of the fourth signal conducting portion 1262 is connected to one end of the sixth conductor 1282, and the other end of the fourth conductor 1272 is connected to the other end of the second ground conducting portion 1263. The other end of the fifth conductor 1281 is connected to the first signal conducting portion 1231 at or near where the first signal conducting portion 1231 is connected to one end of the capacitor 1250, and the other end of the sixth conductor 1282 is connected to the second signal conducting portion 1232 at or near where the second signal conducting portion 1232 is connected to the other end of the capacitor 1250. Thus, the fifth conductor 1281 and the sixth conductor 1282 are connected in parallel with both ends of the capacitor 1250. In this example, the fifth conductor 1281 and the sixth conductor 1282 may be used as input ports to receive an RF signal as an input.

Accordingly, the third signal conducting portion 1261, the fourth signal conducting portion 1262, the second ground conducting portion 1263, the third conductor 1271, the fourth conductor 1272, the fifth conductor 1281, the sixth conductor 1282, and the resonator 1210 are connected to each other, causing the resonator 1210 and the feeder 1220 to have an electrically closed loop structure. The term "loop structure" includes a polygonal structure, a circular structure, a rectangular structure, and any other geometrical structure that is closed, i.e., a geometrical structure that does not have any opening in its perimeter. The expression "having a loop structure" indicates a structure that is electrically closed.

If an RF signal is input to the fifth conductor 1281 or the sixth conductor 1282, an input current flows through the feeder 1220 and the resonator 1210, generating a magnetic field that induces a current in the resonator 1210. A direction of the input current flowing through the feeder 1220 is the same as a direction of the induced current flowing through the resonator 1210, thereby causing a strength of a total magnetic field to increase in the center of the resonator 1210, and decrease near the outer periphery of the resonator 1210.

An input impedance is determined by an area of a region between the resonator 1210 and the feeder 1220. Accordingly, a separate matching network used to match the input impedance to an output impedance of a power amplifier may not be necessary. However, even if a matching network is used, the input impedance may be adjusted by adjusting a size of the feeder 1220, and accordingly a structure of the matching network may be simplified. The simplified structure of the matching network may reduce a matching loss of the matching network.

The second transmission line, the third conductor 1271, the fourth conductor 1272, the fifth conductor 1281, and the sixth conductor 1282 of the feeder 1220 may have a same structure as the resonator 1210. For example, if the resonator 1210 has a loop structure, the feeder 1220 may also have a loop structure. As another example, if the resonator 1210 has a circular structure, the feeder 1220 may also have a circular structure.

Figure 13A:
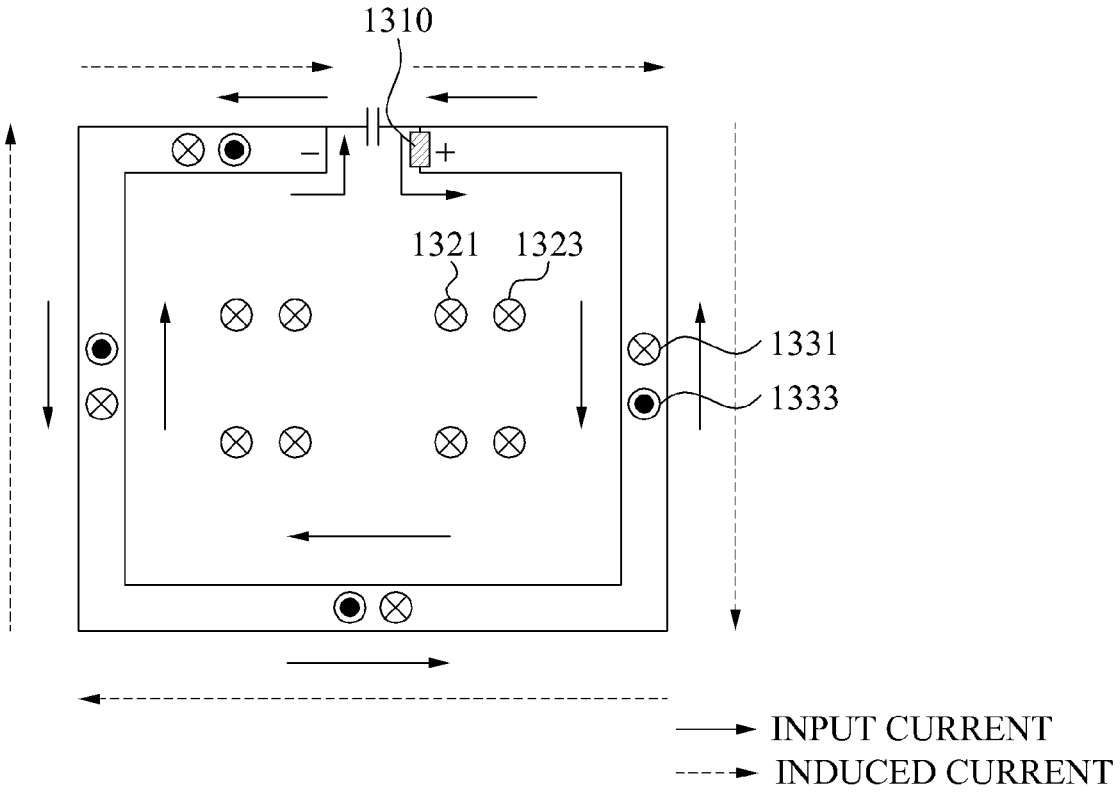
FIG. 13A illustrates an example of a distribution of a magnetic field inside a resonator of a wireless power transmitter produced by feeding a feeder.

FIG. 13A illustrates an example of a distribution of a magnetic field inside a resonator of a wireless power transmitter produced by feeding a feeder. FIG. 13A more simply illustrates the resonator 1210 and the feeder 1220 of FIGS. 12A and 12B, and the following description of FIG. 13A refers to reference numerals shown in FIGS. 12A and 12B.

A feeding operation may be an operation of supplying power to a source resonator in wireless power transmission, or an operation of supplying AC power to a rectifier in wireless power transmission. FIG. 13A illustrates a direction of an input current flowing in the feeder, and a direction of an induced current induced in the source resonator. Additionally, FIG. 13A illustrates a direction of a magnetic field generated by the input current of the feeder, and a direction of a magnetic field generated by the induced current of the source resonator.

Referring to FIG. 13A, the fifth conductor 1281 or the sixth conductor 1282 of the feeder 1220 of FIG. 12A may be used as an input port 1310. In FIG. 13A, the sixth conductor 1282 of the feeder 1220 is being used as the input port 1310. The input port 1310 may receive an RF signal as an input. The RF signal may be output from a power amplifier. The power amplifier may increase and decrease an amplitude of the RF signal based on a power requirement of a target device. The RF signal input to the input port 1310 is represented in FIG. 13A as an input current flowing in the feeder 1220. The input current flows in a clockwise direction in the feeder 1220 along the second transmission line of the feeder 1220. The fifth conductor 1281 and the sixth conductor 1282 of the feeder 1220 are electrically connected to the resonator 1210. More specifically, the fifth conductor 1281 is connected to the first signal conducting portion 1231 of the resonator 1210, and the sixth conductor 1282 of the feeder 1220 is connected to the second signal conducting portion 1232 of the resonator 1210. Accordingly, the input current flows in both the resonator 1210 and the feeder 1220. The input current flows in a counterclockwise direction in the resonator 1210 along the first transmission line of the resonator 1210. The input current flowing in the resonator 1210 generates a magnetic field, and the magnetic field induces a current in the resonator 1210. The induced current flows in a clockwise direction in the resonator 1210 along the first transmission line of the resonator 1210. The induced current supplies energy to the capacitor 1211 of the resonator 1210, and also generates a magnetic field. In FIG. 13A, the input current flowing in the feeder 1220 and the resonator 1210 is indicated by solid lines with arrowheads, and the induced current flowing in the resonator 1210 is indicated by dashed lines with arrowheads.

A direction of a magnetic field generated by a current may be determined based on the right-hand rule. As illustrated in FIG. 13A, inside the feeder 1220, a direction 1321 of the magnetic field generated by the input current flowing in the feeder 1220 is the same as a direction 1323 of the magnetic field generated by the induced current flowing in the resonator 1210. Accordingly, a strength of a total magnetic field increases inside the feeder 1220.

In contrast, as illustrated in FIG. 13A, in a region between the feeder 1220 and the resonator 1210, a direction 1333 of the magnetic field generated by the input current flowing in the feeder 1220 is opposite to a direction 1331 of the magnetic field generated by the induced current flowing in the resonator 1210. Accordingly, the strength of the total magnetic field decreases in the region between the feeder 1220 and the resonator 1210.

Typically, in a resonator having a loop structure, a strength of a magnetic field decreases in the center of the resonator, and increases near an outer periphery of the resonator. However, referring to FIG. 13A, since the feeder 1220 is electrically connected to both ends of the capacitor 1211 of the resonator 1210, the induced current in the resonator 1210 flows in the same direction as the input current in the feeder 1220. Since the induced current in the resonator 1210 flows in the same direction as the input current in the feeder 1220, the strength of the total magnetic field increases inside the feeder 1220, and decreases outside the feeder 1220. As a result, the strength of the total magnetic field increases in the center of the resonator 1210 having the loop structure, and decreases near an outer periphery of the resonator 1210 due to the influence of the feeder 1220. Thus, the strength of the total magnetic field may be constant inside the resonator 1210.

A wireless power transmission efficiency of transmitting wireless power from a source resonator to a target resonator is proportional to the strength of the total magnetic field generated in the source resonator. Accordingly, when the strength of the total magnetic field increases inside the source resonator, the wireless power transmission efficiency also increases.

Figure 13B:
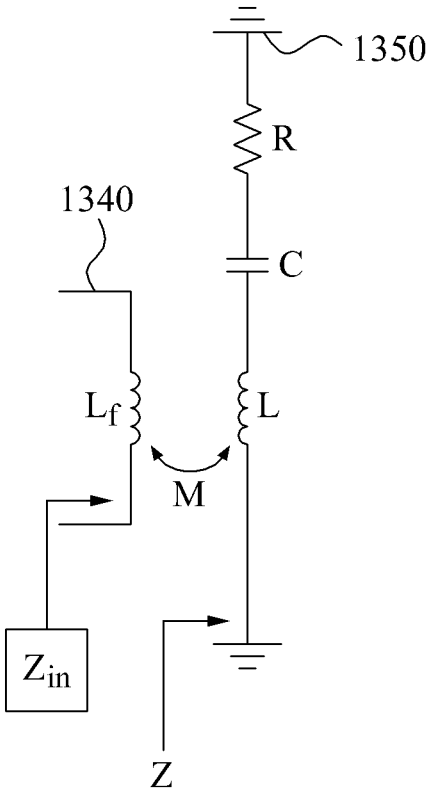
FIG. 13B illustrates an example of equivalent circuits of a feeder and a resonator of a wireless power transmitter.

FIG. 13B illustrates an example of equivalent circuits of a feeder and a resonator of a wireless power transmitter. Referring to FIG. 13B, a feeder 1340 and a resonator 1350 may be represented by the equivalent circuits in FIG. 13B. The feeder 1340 is represented as an inductor having an inductance $L_f$, and the resonator 1350 is represented as a series connection of an inductor having an inductance L coupled to the inductance $L_f$ of the feeder 1340 by a mutual inductance M, a capacitor having a capacitance C, and a resistor having a resistance R. An example of an input impedance $Z_{in}$ viewed in a direction from the feeder 1340 to the resonator 1350 may be expressed by the following Equation 1.

$$Z_{in} = \frac{(\omega M)^2}{Z} \tag{1}$$

In Equation 1, M denotes a mutual inductance between the feeder 1340 and the resonator 1350, ω denotes a resonant frequency of the feeder 1340 and the resonator 1350, and Z denotes an impedance viewed in a direction from the resonator 1350 to a target device. As can be seen from FIG. 1, the input impedance $Z_{in}$ is proportional to the square of the mutual inductance M. Accordingly, the input impedance $Z_{in}$ may be adjusted by adjusting the mutual inductance M between the feeder 1340 and the resonator 1350. The mutual inductance M depends on an area of a region between the feeder 1340 and the resonator 1350. The area of the region between the feeder 1340 and the resonator 1350 may be adjusted by adjusting a size of the feeder 1340, thereby adjusting the mutual inductance M and the input impedance $Z_{in}$. Since the input impedance $Z_{in}$ may be adjusted by adjusting the size of the feeder 1340, it may be unnecessary to use a separate matching network to perform impedance matching with an output impedance of a power amplifier.

If the resonator 1350 and the feeder 1340 are used in a wireless power reception apparatus with the resonator 1350 operating as a target resonator, a magnetic field may be distributed as illustrated in FIG. 13A. For example, the target resonator may receive wireless power from a source resonator via magnetic coupling. The received wireless power induces a current in the target resonator. The induced current generates a magnetic field, which induces a current in the feeder 1340. If the resonator 1350 operating as the target resonator is connected to the feeder 1340 as illustrated in FIG. 13A, the induced current flowing in the resonator 1350 will flow in the same direction as the induced current flowing in the feeder 1340. Accordingly, for the reasons discussed above in connection with FIG. 13A, a strength of the total magnetic field will increase inside the feeder 1340, and will decrease in a region between the feeder 1340 and the resonator 1350.

The TX controller 114, the communication units 115 and 124, the RX controller 125, the sensor 240, the controllers 250, 350, and 514, the modulator 260, the frequency generators 310 and 511, and the demodulators 340 and 513 in FIGS. 1-3 and 5 described above that perform the operations illustrated in FIGS. 5, 6, 9, 10A, and 10B may be implemented using one or more hardware components, one or more software components, or a combination of one or more hardware components and one or more software components.

A hardware component may be, for example, a physical device that physically performs one or more operations, but is not limited thereto. Examples of hardware components include resistors, capacitors, inductors, power supplies, frequency generators, operational amplifiers, power amplifiers, low-pass filters, high-pass filters, band-pass filters, analog-to-digital converters, digital-to-analog converters, and processing devices.

A software component may be implemented, for example, by a processing device controlled by software or instructions to perform one or more operations, but is not limited thereto. A computer, controller, or other control device may cause the processing device to run the software or execute the instructions. One software component may be implemented by one processing device, or two or more software components may be implemented by one processing device, or one software component may be implemented by two or more processing devices, or two or more software components may be implemented by two or more processing devices.

A processing device may be implemented using one or more general-purpose or special-purpose computers, such as, for example, a processor, a controller and an arithmetic logic unit, a digital signal processor, a microcomputer, a field-programmable array, a programmable logic unit, a microprocessor, or any other device capable of running software or executing instructions. The processing device may run an operating system (OS), and may run one or more software applications that operate under the OS. The processing device may access, store, manipulate, process, and create data when running the software or executing the instructions. For simplicity, the singular term "processing device" may be used in the description, but one of ordinary skill in the art will appreciate that a processing device may include multiple processing elements and multiple types of processing elements. For example, a processing device may include one or more processors, or one or more processors and one or more controllers. In addition, different processing configurations are possible, such as parallel processors or multi-core processors.

A processing device configured to implement a software component to perform an operation A may include a processor programmed to run software or execute instructions to control the processor to perform operation A. In addition, a processing device configured to implement a software component to perform an operation A, an operation B, and an operation C may have various configurations, such as, for example, a processor configured to implement a software component to perform operations A, B, and C; a first processor configured to implement a software component to perform operation A, and a second processor configured to implement a software component to perform operations B and C; a first processor configured to implement a software component to perform operations A and B, and a second processor configured to implement a software component to perform operation C; a first processor configured to implement a software component to perform operation A, a second processor configured to implement a software component to perform operation B, and a third processor configured to implement a software component to perform operation C; a first processor configured to implement a software component to perform operations A, B, and C, and a second processor configured to implement a software component to perform operations A, B, and C, or any other configuration of one or more processors each implementing one or more of operations A, B, and C. Although these examples refer to three operations A, B, C, the number of operations that may implemented is not limited to three, but may be any number of operations required to achieve a desired result or perform a desired task.

Software or instructions for controlling a processing device to implement a software component may include a computer program, a piece of code, an instruction, or some combination thereof, for independently or collectively instructing or configuring the processing device to perform one or more desired operations. The software or instructions may include machine code that may be directly executed by the processing device, such as machine code produced by a compiler, and/or higher-level code that may be executed by the processing device using an interpreter. The software or instructions and any associated data, data files, and data structures may be embodied permanently or temporarily in any type of machine, component, physical or virtual equipment, computer storage medium or device, or a propagated signal wave capable of providing instructions or data to or being interpreted by the processing device. The software or instructions and any associated data, data files, and data structures also may be distributed over network-coupled computer systems so that the software or instructions and any associated data, data files, and data structures are stored and executed in a distributed fashion.

For example, the software or instructions and any associated data, data files, and data structures may be recorded, stored, or fixed in one or more non-transitory computer-readable storage media. A non-transitory computer-readable storage medium may be any data storage device that is capable of storing the software or instructions and any associated data, data files, and data structures so that they can be read by a computer system or processing device. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, or any other non-transitory computer-readable storage medium known to one of ordinary skill in the art.

Functional programs, codes, and code segments for implementing the examples disclosed herein can be easily constructed by a programmer skilled in the art to which the examples pertain based on the drawings and their corresponding descriptions as provided herein.

While this disclosure includes specific examples, it will be apparent to one of ordinary skill in the art that various changes in form and details may be made in these examples without departing from the spirit and scope of the claims and their equivalents. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A reception (RX) node using mutual resonance, the RX node comprising:

a target resonator configured to receive power via mutual resonance with a source resonator;

a sensor configured to sense information in response to the received power;

a controller configured to, in response to the received power:

determine a point in time at which the controller wakes up to be a point in time at which synchronization with other RX nodes is performed;

generate a data packet comprising the sensed information; and transmit the data packet to the source resonator via the target resonator at a timing that is set based on the determined point to prevent the RX node from colliding with any of the other RX nodes.

2. The RX node of claim 1, wherein the controller is further configured to transmit the data packet to the source resonator via the target resonator after a data transmission waiting time elapses from a time the power is received by the target resonator;

wherein the data transmission waiting time is set for the RX node to prevent the RX node from colliding with the any of the other RX nodes.

3. The RX node of claim 1, further comprising a modulator configured to modulate the data packet using a load modulation scheme;

wherein the target resonator is further configured to transmit the modulated data packet to the source resonator via the mutual resonance.

4. The RX node of claim 1, wherein the power received by the target resonator is alternating current (AC) power; and the RX node further comprises:

a rectifier configured to:

receive the AC power from the target resonator; and rectify the AC power to direct current (DC) power; and a DC-to-DC (DC/DC) converter configured to:

convert a voltage level of the DC power to a rated voltage level of the controller; and convert the voltage level of the DC power to a rated voltage level of the sensor.

5. The RX node of claim 1, wherein the controller is further configured to output a sensing request;

the sensor comprises a battery configured to be charged by the received power; and the sensor is further configured to:

receive the sensing request from the controller;

determine whether an amount of power stored in the battery is equal to or greater than a minimum amount of power the sensor needs to sense the information; and sense the information in response to the sensing request and a result of the determining being that the amount of power stored in the battery is equal to or greater than the minimum amount of power the sensor needs to sense the information.

6. The RX node of claim 1, wherein the source resonator is mounted in a door of a kimchi refrigerator;

the target resonator, the controller, and the sensor are mounted in a kimchi container of the kimchi refrigerator;

the sensor is further configured to sense an acidity of kimchi in the kimchi container, and an internal temperature of the kimchi container; and the controller is further configured to determine an aging state of the kimchi based on the acidity.

7. The RX node of claim 1, wherein the source resonator is mounted in a door of a washing machine;

the target resonator, the controller, and the sensor are mounted in a washing container of the washing machine;

the sensor is further configured to sense any one or any combination of a weight of laundry in the washing container, a pressure of water flowing into the washing container, an internal temperature of the washing container, and an internal humidity of the washing container; and the controller is further configured to determine a washing state of the laundry.

8. The RX node of claim 1, wherein the controller is further configured to transmit the data packet to the source resonator via the target resonator at a bandwidth corresponding to the mutual resonance.

9. A transmission (TX) node using mutual resonance, the TX node comprising:

a source resonator configured to:

transmit power via mutual resonance with a target resonator of an RX node; and receive a signal from the target resonator, the signal having been generated by the RX node load-modulating a data packet and transmitted at a timing that is set based on a point;

a demodulator configured to demodulate the data packet based on a change in a waveform of the signal received by the source resonator; and a controller configured to display information in the demodulated data packet on a display window, wherein the point is determined in time at which the RX node wakes up to be a point in time at which synchronization with other RX nodes is performed.

10. The TX node of claim 9, wherein the controller is further configured to determine an amount of power to be transmitted by the source resonator based on a power level needed to wake up a controller and a sensor of the RX node.

11. The TX node of claim 9, wherein the controller is further configured to:

interrupt transmission of the power from the source resonator in response to completion of receiving of the data packet from the RX node; and restart transmission of the power from the source resonator in response to a predetermined delay period elapsing after the interruption of the transmission of the power.

12. The TX node of claim 9, further comprising:

a frequency generator configured to generate a signal having a resonant frequency enabling the source resonator and the target resonator to mutually resonate; and an amplifier configured to amplify the signal having the resonant frequency to a controllable power level;

wherein the controller is further configured to control the amplifier to control the power level of the amplified signal.

13. The TX node of claim 9, wherein the source resonator, the demodulator, and the controller are mounted in a door of a kimchi refrigerator;

the RX node is mounted in a kimchi container of the kimchi refrigerator; and the controller is further configured to:

acquire an aging state of kimchi in the kimchi container from the demodulated data packet; and display the acquired aging state on the display window.

14. The TX node of claim 9, wherein the source resonator, the demodulator, and the controller are mounted in a door of a washing machine;

the RX node is mounted in a washing container of the washing machine; and the controller is further configured to:

acquire washing information of laundry in the washing container from the demodulated data packet; and display the acquired washing information on the display window.

15. A system for transceiving power and data using mutual resonance, the system comprising:

a transmission (TX) node comprising a source resonator configured to transmit power; and a plurality of reception (RX) nodes each comprising:

a target resonator configured to receive power from the source resonator via mutual resonance with the source resonator;

a controller configured to:

wake up in response to the received power;

determine a point in time at which the controller wakes up to be a point in time at which synchronization with other RX nodes of the plurality of RX nodes is performed; and generate a data packet; and a sensor configured to:

wake up in response to the received power; and sense information;

wherein the source resonator and the target resonator of each of the plurality of RX nodes are further configured so that the source resonator mutually resonates with the target resonator of each of the plurality of RX nodes at a same resonant frequency.

16. The system of claim 15, wherein the TX node is mounted in a door of a kimchi refrigerator;

the plurality of RX nodes are respectively mounted in a plurality of kimchi containers of the kimchi refrigerator;

the sensor of each of the plurality of RX nodes is further configured to sense an acidity of kimchi in a respective one of the plurality of kimchi containers, and an internal temperature of the respective one of the plurality of kimchi containers;

the controller of each of the plurality of RX nodes is further configured to:

determine an aging state of the kimchi in the respective one of the kimchi containers based on the acidity; and generate the data packet so that the data packet comprises:

identification information of a respective one of the plurality of RX nodes;

the acidity;

the internal temperature;

the aging state;

a time required to transmit the data packet; and a data packet transmission waiting time set for the respective one of the plurality of RX nodes to prevent the respective one of the plurality of RX nodes from colliding with the other RX nodes of the plurality of RX nodes;

the target resonator of each of the plurality of RX nodes is further configured to transmit the data packet of the respective one of the plurality of RX nodes to the source resonator of the TX node via the mutual resonance;

the source resonator of the TX node is further configured to receive the data packet from the target resonator of each of the plurality of RX nodes via the mutual resonance;

the TX node is further configured to:

acquire the aging state of the kimchi in each of the plurality of kimchi containers and the internal temperature of each of the plurality of kimchi containers from the data packet of each of the plurality of RX nodes received by the source resonator; and display on a display window of the kimchi refrigerator the acquired aging state of the kimchi in each of the plurality of kimchi containers and the acquired internal temperature of each of the plurality of kimchi containers.

17. The system of claim 15, wherein each of the plurality of RX nodes is further configured to generate a signal by load-modulating the data packet;

the target resonator of each of the plurality of RX nodes is further configured to transmit the signal to the source resonator of the TX node via the mutual resonance;

the source resonator of the TX node is further configured to receive the signal from the target resonator of each of the plurality of RX nodes via the mutual resonance; and the TX node further comprises:

a demodulator configured to demodulate the data packet of each of the plurality of RX nodes based on a change in a waveform of the signal received by the source resonator from the target resonator of each of the plurality of RX nodes; and a controller configured to:

acquire information from the demodulated data packet of each of the plurality of RX nodes; and display the acquired information on a display window.

18. A method of transceiving power and data using mutual resonance, the method comprising:

transmitting, by a source resonator of a transmission (TX) node, power to a target resonator of each of a plurality of reception (RX) nodes via mutual resonance between the source resonator and the target resonator of each of the plurality of RX nodes;

in each of the plurality of RX nodes, receiving, by the target resonator, power from the source resonator, and rectifying the received power;

in each of the plurality of RX nodes, waking up a controller and a sensor of the RX node in response to the received power;

in each of the plurality of RX nodes, sensing, by the sensor, information;

in each of the plurality of RX nodes, generating, by the controller of the RX node, a data packet;

in each of the plurality of RX nodes, modulating, by a modulator of the RX node, the data packet using a load modulation scheme in response to elapsing of a respective data transmission waiting time set for the RX node to prevent the RX node from colliding with other RX nodes of the plurality of RX nodes;

receiving, by the source resonator, a signal from each of the plurality of RX nodes;

demodulating, by a demodulator of the TX node, the modulated data packet of each of the plurality of RX nodes based on a change in a waveform of the signal received by the source resonator from each of the plurality of RX nodes;

displaying, by a controller of the TX node, information in the demodulated data packet of each of the plurality of RX nodes on a display window; and interrupting, by the controller of the TX node, transmission of the power.

19. The method of claim 18, wherein the TX node is mounted in a door of a kimchi refrigerator;

the plurality of RX nodes are respectively mounted in a plurality of kimchi containers of the kimchi refrigerator; and the method further comprises:

in each of the plurality of RX nodes, sensing, by the sensor, an acidity of kimchi in a respective kimchi container of the plurality of kimchi containers, and an internal temperature of the respective kimchi container; and in each of the plurality of RX nodes, determining, by the controller of the RX node, an aging state of the kimchi based on the acidity.

20. The method of claim 19, further comprising generating, by the controller of each of the plurality of RX nodes, the data packet so that the data packet comprises:

identification information of a respective one of the plurality of RX nodes;

the acidity;

the internal temperature;

the aging state;

a time required to transmit the data packet; and a data packet transmission waiting time set for the RX node to prevent the RX node from colliding with other RX nodes of the plurality of RX nodes.

21. The method of claim 20, wherein the display window is a display window of the kimchi refrigerator; and the displaying comprises:

acquiring, by the controller of the TX node, the aging state of the kimchi in each of the plurality of kimchi containers and the internal temperature of each of the plurality of kimchi containers from the demodulated data packet of each of the plurality of RX nodes; and displaying, by the controller of the TX node, on the display window of the kimchi refrigerator the acquired aging state of the kimchi in each of the plurality of kimchi containers and the acquired internal temperature of each of the plurality of kimchi containers.

* * * * *